US011380286B2

(12) United States Patent
Lee et al.

(10) Patent No.: US 11,380,286 B2
(45) Date of Patent: Jul. 5, 2022

(54) ELECTRONIC DEVICE AND METHOD FOR CONTROLLING TIMING SIGNAL

(71) Applicant: Samsung Electronics Co., Ltd., Gyeonggi-do (KR)

(72) Inventors: Gwanghui Lee, Gyeonggi-do (KR); Minwoo Kim, Gyeonggi-do (KR); Seungjin Kim, Gyeonggi-do (KR); Minwoo Lee, Gyeonggi-do (KR); Juseok Lee, Gyeonggi-do (KR); Woojun Jung, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/155,132

(22) Filed: Jan. 22, 2021

(65) Prior Publication Data

US 2021/0248980 A1 Aug. 12, 2021

(30) Foreign Application Priority Data

Feb. 10, 2020 (KR) ..... 10-2020-0015936

(51) Int. Cl.

| | |
|---|---|
| ***G09G 5/36*** | (2006.01) |
| ***G09G 5/18*** | (2006.01) |
| ***G09G 5/12*** | (2006.01) |

(52) U.S. Cl.

CPC ..... *G09G 5/363* (2013.01); *G09G 5/12* (2013.01); *G09G 5/18* (2013.01); *G09G 2330/021* (2013.01); *G09G 2360/12* (2013.01)

(58) Field of Classification Search

CPC ..... G09G 2360/18; G09G 2330/021; G09G 2340/0435; G09G 5/12; G09G 2310/08;

(Continued)

(56) References Cited

U.S. PATENT DOCUMENTS

2013/0155036 A1 6/2013 Kim et al.
2015/0015591 A1 1/2015 Oh et al.

(Continued)

FOREIGN PATENT DOCUMENTS

KR 10-2013-0070765 A 6/2013
KR 10-2014-0098409 A 8/2014

(Continued)

OTHER PUBLICATIONS

International Search Report dated May 4, 2021.

*Primary Examiner* — Hau H Nguyen
(74) *Attorney, Agent, or Firm* — Cha & Reiter, LLC

(57) ABSTRACT

According to an embodiment, an electronic device may include at least one processor, a display, a memory configured to store image frames, and a display controller configured to output the image frames. The at least one processor may be configured to transmit a first image frame to be output through the display, based on a first timing signal received from the display controller, identify a state of the electronic device, transmit first control information for changing a timing of the first timing signal, in response to transmitting the first control information for changing the timing of the first timing signal, receive a second timing signal from the display controller, and transmit, to the memory, a second image frame to be output through the display, based on the received second timing signal. The timing of the second timing signal may differ from the timing of the first timing signal.

19 Claims, 20 Drawing Sheets

(58) Field of Classification Search
CPC ..... G09G 5/18; G09G 2310/0264; G09G 2320/0613; G09G 5/395; G06F 3/14
See application file for complete search history.

(56) References Cited

U.S. PATENT DOCUMENTS

| | | | | |
|---|---|---|---|---|
| 2015/0130824 | A1 | 5/2015 | Lee et al. | |
| 2016/0078846 | A1 | 3/2016 | Liu et al. | |
| 2017/0193971 | A1 | 7/2017 | Bi et al. | |
| 2018/0040301 | A1 | 2/2018 | Bae et al. | |
| 2018/0158424 | A1* | 6/2018 | Okamoto ..... | G09G 5/005 |

FOREIGN PATENT DOCUMENTS

| | | | |
|---|---|---|---|
| KR | 10-2018-0015038 | A | 2/2018 |
| WO | 2018/026173 | A1 | 2/2018 |

* cited by examiner

ELECTRONIC DEVICE AND METHOD FOR CONTROLLING TIMING SIGNAL

CROSS-REFERENCE TO RELATED APPLICATION(S)

This application is based on and claims priority under 35 U.S.C. 119 to Korean Patent Application No. 10-2020-0015936, filed on Feb. 10, 2020, in the Korean Intellectual Property Office, the disclosure of which is herein incorporated by reference in its entirety.

BACKGROUND

Field

One or more embodiments of the instant disclosure generally relate to electronic devices that can control timing signal and methods for the same.

Description of Related Art

More and more services and an increasing number of functions are being provided by electronic devices, e.g., smartphones, or other portable electronic devices. To meet the needs of various users and increase efficiency of use of the electronic devices, communication service carriers or device manufacturers are jumping into competitions to develop electronic devices with differentiated and diversified functionalities. Accordingly, various functions that are provided by electronic devices are evolving more and more.

A display device driven using commands may read data (e.g., an image frame) from a memory (e.g., graphic random-access memory (GRAM)) and output the image via a display panel in synchronization with a synchronization signal (e.g., a vertical synchronization (VSYNC) signal) generated by a display driver integrated circuit (IC) (DDI). In this case, the display driver IC may read data (e.g., image frames) and transmit the data to the display (e.g., panel) during a scan-on time for every period (e.g., every interval) of the synchronization signal (e.g., VSYNC signal).

A processor (e.g., a display processing unit (DPU)) may transmit every piece of data (e.g., image frame) to the memory (e.g., GRAM) and store the data in the GRAM in response to the timing signal received in response to the synchronization signal (e.g., VSYNC signal) generated by the display driver IC. The processor may be configured to transmit every piece of data (e.g., image frame) to the GRAM within the scan-on time of the display driver IC (e.g., before the scan-on time expires) so that no tearing effect occurs.

The interval of the synchronization signal (e.g., VSYNC signal) described above may correspond to the refresh rate of the display. The processor may dynamically change the interval of the synchronization signal (e.g., VSYNC signal) to dynamically change the refresh rate of the display depending on whether a high responsiveness is required or whether longer battery life is needed (e.g., whether low power consumption is needed). The shorter the interval of the synchronization signal (e.g. VSYNC signal), the less time it takes for data (e.g., image frame) transmitted from the processor to be output through the panel of the display (in other words, high responsiveness is guaranteed). However, since the scan-on time of the display driver IC is shortened, the processor may need to operate at high operation speeds in order to transmit data (e.g., image frames) to the memory (e.g., GRAM) within the scan-on time of the display driver IC. Thus, the power consumption of the processor may further be increased. Conversely, the longer the interval of the timing signal (e.g. VSYNC signal), the longer it takes for data (e.g. image frame) transmitted from the processor to be output through the panel of the display (in other words, low responsiveness is provided). In turn, since the scan-on time of the display driver IC has increased, the processor may transmit data (e.g., image frames) to the memory (e.g., GRAM) within the scan-on time of the display driver IC even when the processor operates at low operation speeds. Thus, the power consumption of the processor may further be decreased.

As described above, the processor may dynamically change the refresh rate of the display by dynamically changing the interval of the synchronization signal (e.g., VSYNC signal) depending on whether high responsiveness is required or longer battery life is required. However, when the scan-on time of the display driver IC is changed, the difference in brightness may be noticed by the user in the images output through the panel of the display when the change is made. This may cause inconvenience to the user when the refresh rate of the display is dynamically changed.

SUMMARY

In accordance with an embodiment, an electronic device comprises at least one processor, a display, a memory configured to store an image frame received from the at least one processor, and a display controller configured to output the image frame stored in the memory through the display. The at least one processor is configured to transmit a first image frame to be output through the display to the memory, based on a first timing signal received from the display controller, identify a state of the electronic device, transmit first control information for changing a timing of the first timing signal to the display controller, in response to the identified state of the electronic device, receive a second timing signal from the display controller, based on the transmission of the first control information for changing the timing of the first timing signal, and transmit a second image frame to be output through the display to the memory, based on the received second timing signal, and wherein the timing of the second timing signal differs from the timing of the first timing signal.

In accordance with an embodiment, a method for controlling an electronic device comprises transmitting a first image frame to be output through a display of the electronic device to a memory of the electronic device, based on a first timing signal received from a display controller of the electronic device, identifying a state of the electronic device, transmitting first control information for changing a timing of the first timing signal to a display controller of the electronic device, based on the identified state of the electronic device, receiving a second timing signal from the display controller, in response to the transmission of the first control information for changing the timing of the first timing signal, and transmitting a second image frame to be output through the display to the memory, based on the received second timing signal, wherein the timing of the second timing signal differs from the timing of the first timing signal.

In accordance with an embodiment, there is provided a computer-readable non-volatile recording medium, storing instructions executed to enable at least one processor of an electronic device to transmit a first image frame to be output through a display of the electronic device to a memory of the electronic device, based on a first timing signal received from a display controller of the electronic device, identify a state of the electronic device, transmit first control information for changing a timing of the first timing signal to a display controller of the electronic device, based on the identified state of the electronic device, receive a second timing signal from the display controller, in response to the transmission of the first control information for changing the timing of the first timing signal, and transmit a second image frame to be output through the display to the memory, based on the received second timing signal, and wherein the timing of the second timing signal differs from the timing of the first timing signal.

Other aspects, advantages, and salient features of the disclosure will become apparent to those skilled in the art from the following detailed description, which, taken in conjunction with the annexed drawings, discloses exemplary embodiments of the disclosure.

BRIEF DESCRIPTION OF THE DRAWINGS

A more complete appreciation of the disclosure and many of the attendant aspects thereof will be readily obtained as the same becomes better understood by reference to the following detailed description when considered in connection with the accompanying drawings, wherein.

Throughout the drawings, like reference numerals will be understood to refer to like parts, components, and structures.

DETAILED DESCRIPTION

According to an embodiment, the electronic device may maintain the scan-on time of the display driver IC even if the interval of the synchronization signal (e.g., a VSYNC signal) is changed depending on whether high responsiveness is required or longer battery life is required.

According to an embodiment, the electronic device may change the timing of a timing signal received in response to the synchronization signal (e.g., a VSYNC signal) depending on whether high responsiveness is required or longer battery life is required, thereby adjusting the time period within which data (e.g., an image frame) may be transmitted to the memory (e.g., GRAM).

Figure 1:
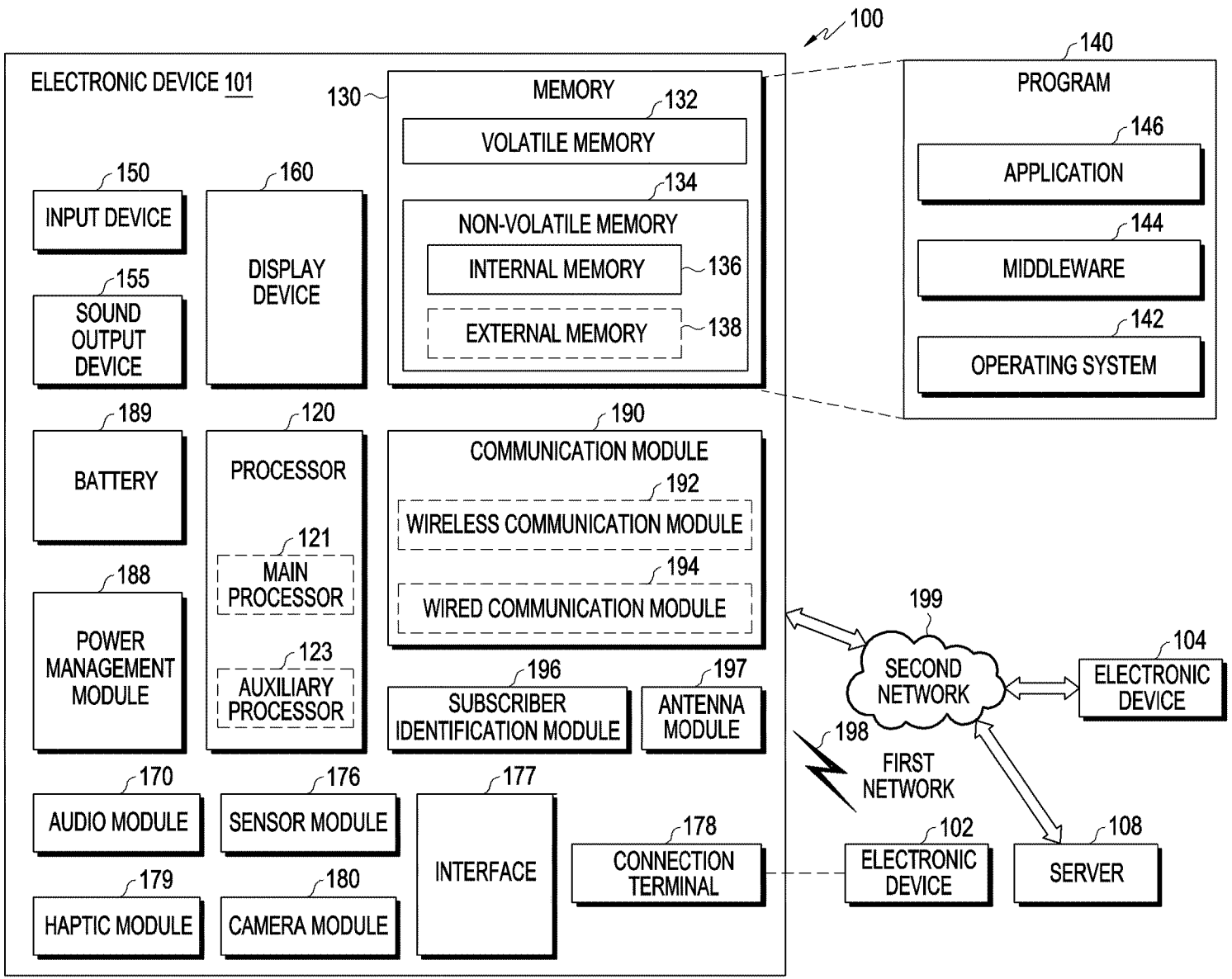
FIG. 1 is a view illustrating an electronic device in a network environment according to various embodiments.

FIG. 1 is a block diagram illustrating an electronic device 101 in a network environment 100 according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or motion) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device). According to an embodiment, the antenna module may include one antenna including a radiator formed of a conductor or conductive pattern formed on a substrate (e.g., a printed circuit board (PCB)). According to an embodiment, the antenna module 197 may include a plurality of antennas. In this case, at least one antenna appropriate for a communication scheme used in a communication network, such as the first network 198 or the second network 199, may be selected from the plurality of antennas by, e.g., the communication module 190. The signal or the power may then be transmitted or received between the communication module 190 and the external electronic device via the selected at least one antenna. According to an embodiment, other parts (e.g., radio frequency integrated circuit (RFIC)) than the radiator may be further formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. The external electronic devices 102 and 104 each may be a device of the same or a different type from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
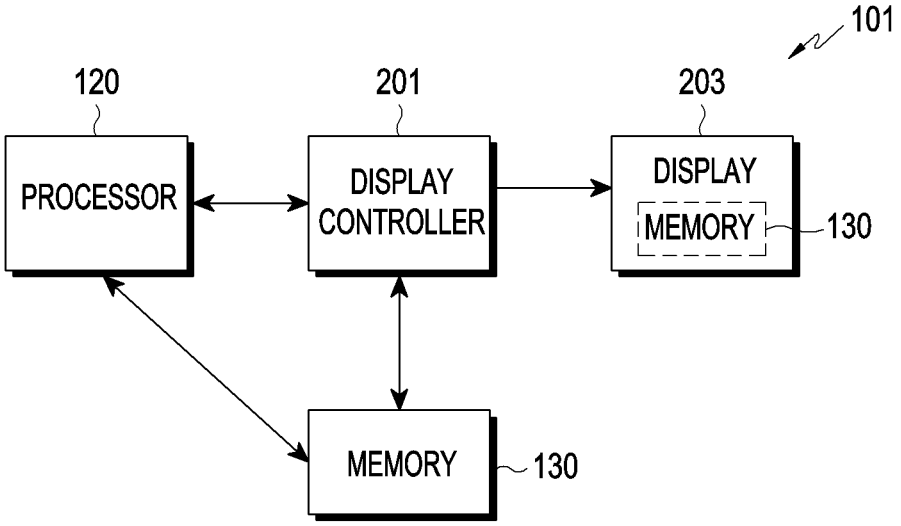
FIG. 2 is a block diagram illustrating components of an electronic device according to an embodiment.

FIG. 2 is a block diagram illustrating components of an electronic device 101 according to an embodiment.

According to an embodiment, the electronic device 101 may include at least one of a processor 120, a display controller 201, and a display 203 (e.g., the display device 160 of FIG. 1).

According to an embodiment, the processor 120 may perform the overall operation of the electronic device 101 and may control the overall operation of other components of the electronic device 101. According to an embodiment, the processor 120 may include the display controller 201 and/or a display processing unit (DPU) that controls the display 203. According to an embodiment, the processor 120 may include an application processor (AP) of the electronic device 101 and may exist as a separate module inside the application processor. The processor 120 may include a microprocessor or any suitable type of processing circuitry, such as one or more general-purpose processors (e.g., ARM-based processors), a Digital Signal Processor (DSP), a Programmable Logic Device (PLD), an Application-Specific Integrated Circuit (ASIC), a Field-Programmable Gate Array (FPGA), a Graphical Processing Unit (GPU), a video card controller, etc. In addition, it would be recognized that when a general purpose computer accesses code for implementing the processing shown herein, the execution of the code transforms the general purpose computer into a special purpose computer for executing the processing shown herein. Certain of the functions and steps provided in the Figures may be implemented in hardware, software or a combination of both and may be performed in whole or in part within the programmed instructions of a computer. No claim element herein is to be construed under the provisions of 35 U.S.C. § 112(f), unless the element is expressly recited using the phrase "means for." In addition, an artisan understands and appreciates that a "processor" or "microprocessor" may be hardware in the claimed disclosure. Under the broadest reasonable interpretation, the appended claims are statutory subject matter in compliance with 35 U.S.C. § 101.

According to an embodiment, the processor 120 may transmit data to the memory 130 and store the data in the memory 130. For example, the data may include an image frame to be output through the display 203.

According to an embodiment, the processor 120 may receive a timing signal from the display controller 201. For example, the timing signal received from the display controller 201 may include a tearing effect synchronization (TE-SYNC) signal. It will be apparent to a person skilled in the art that the TE-SYNC signal may be referred to as a tearing effect (TE) signal, a timing signal, a tearing signal, or a tearing effect synchronization signal, or by other various terms. In the instant disclosure, the timing signal received from the display controller 201 may be referred to as a TE-SYNC signal, a first timing signal, or a second timing signal. According to an embodiment, the TE-SYNC signal may be a signal corresponding to a synchronization signal (e.g., a VSYNC signal) generated by the display controller 201, which is described later. According to an embodiment, the timing signal (e.g., TE-SYNC signal) received from the display controller 201 may include an electrical signal whose voltage value rises and/or falls at predetermined periods or intervals. For example, the timing signal (e.g., TE-SYNC signal) received from the display controller 201 may include a signal whose voltage value rises and/or falls with the same period (e.g., same interval) as the synchronization signal (e.g., a VSYNC signal).

According to an embodiment, the processor 120 may transmit data (e.g., image frame) to the display controller 201 or the memory 130 in response to the timing signal (e.g., TE-SYNC signal) received from the display controller 201. According to an embodiment, the processor 120 may transmit data (e.g., image frame) to the display controller 201 or the memory 130 in response to a rise in the voltage value of the timing signal (e.g., TE-SYNC signal). According to an embodiment, data (e.g., image frame) transmission by the processor 120 may be performed via a wired and/or wirelessly. According to an embodiment, wired transmission of data (e.g., image frame) may be performed through a display port that connects the processor 120 and the display controller 201 and/or the memory 130 via a wire. According to an embodiment, wireless transmission of data (e.g., an image frame) may include long-range wireless communication, such as cellular communication, and/or short-range wireless communication, such as Bluetooth (BL) communication, near field communication (NFC) communication, or wireless-fidelity (Wi-Fi) communication. In addition to the above-described wired and/or wireless transmissions, data (e.g., image frames) may be transmitted to the display controller 201 and/or the memory 130 according to various other transmission methods.

According to an embodiment, the processor 120 may change the rising timing (e.g., timing when the voltage value of the TE-SYNC signal rises) of the timing signal (e.g., TE-SYNC signal) received from the display controller 201. According to an embodiment, the processor 120 may transmit control information (e.g., first control information) to the display controller 201 and control the display controller 201 to transmit a timing signal (e.g., a TE-SYNC signal) whose rising timing has been changed. According to an embodiment, the processor 120 may change the rising timing of the timing signal (e.g., TE-SYNC signal) based on the state of the electronic device 101, which is described below in detail. For example, the state of the electronic device 101 may include at least one of the type of application(s) executed on the electronic device 101, the content of the screen (e.g., the execution screen of the application) displayed on the display 203 of the electronic device 101, the type of user input received, and the temperature of the electronic device 101.

According to an embodiment, the processor 120 may change the interval of a synchronization signal (e.g., a VSYNC signal) generated by the display controller 201. According to an embodiment, the processor 120 may transmit control information (e.g., second control information) to the display controller 201 and control the display controller 201 to change the interval of the synchronization signal (e.g., VSYNC signal). According to an embodiment, upon identifying that a predetermined application is executed or the temperature of the electronic device 101 exceeds a predetermined temperature, the processor 120 may change the interval of the synchronization signal (e.g., VSYNC signal), which is described below in detail.

According to an embodiment, the display controller 201 may control the overall operation of the display 203. For example, the display controller 201 may include a display driver IC (DDI) that controls the display 203.

According to an embodiment, the display controller 201 may generate a synchronization signal. For example, the synchronization signal may include a VSYNC signal. It will be apparent to those skilled in the art that the VSYNC signal may be referred to as a timing signal or a vertical synchronization signal, or by other various terms. In the disclosure, the synchronization signal is referred to as a VSYNC signal. According to an embodiment, the synchronization signal (e.g., VSYNC signal) may include an electrical signal whose voltage value rises and/or falls at predetermined periods (e.g., intervals).

According to an embodiment, the display controller 201 may transmit data (e.g., an image frame) stored in the memory 130 to the display 203 based on the synchronization signal (e.g., a VSYNC signal). According to an embodiment, the display controller 201 may transmit data (e.g., an image frame) to the display 203 based on a rise in the voltage value of the synchronization signal (e.g., a VSYNC signal). According to an embodiment, the operation of transmitting data (e.g., image frame) to the display 203 by the display controller 201 may be referred to as the operation of reading (or scanning) the data (e.g., image frame) by the display controller 201 or the operation of reading (or scanning) and transmitting the data to the display 203. According to an embodiment, the interval of the synchronization signal (e.g., a VSYNC signal) may be reciprocal to the refresh rate of the display 203.

According to an embodiment, the display controller 201 may generate a timing signal (e.g., a TE-SYNC signal) corresponding to the synchronization signal (e.g., a VSYNC signal) and transmit the timing signal (e.g., TE-SYNC signal) to the processor 120. According to an embodiment, the display controller 201 may transmit the timing signal (e.g., TE-SYNC signal) corresponding to the synchronization signal (e.g., a VSYNC signal) to the processor 120, thereby providing the processor 120 with the interval of the synchronization signal (e.g., VSYNC signal) and/or the timing of reading and transmitting the data (e.g., image frame) to the display 203. According to an embodiment, the timing signal (e.g., a TE-SYNC signal) may have its voltage value rise and/or fall at the timing corresponding to the synchronization signal (e.g., a VSYNC signal) or may have its voltage value rise and/or fall at the timing different from that of the synchronization signal (e.g., a VSYNC signal).

According to an embodiment, the memory 130 may include a Graphics Random Access Memory (GRAM) (e.g., the volatile memory 132 of FIG. 1) for temporarily storing data (e.g., image frame) received from the processor 120. According to an embodiment, the memory 130 may be included in the display controller 201 or may be included in the display 203.

According to an embodiment, the display 203 may visually output data (e.g., an image frame) received from the display controller 201. According to an embodiment, the display 203 may be interchangeably used with the term "display panel." According to an embodiment, the display 203 may include a touch screen for receiving touch inputs.

For convenience of description, the timing signal and synchronization signal, respectively, are referred to herein as TE-SYNC signal and VSYNC signal.

Figure 3:
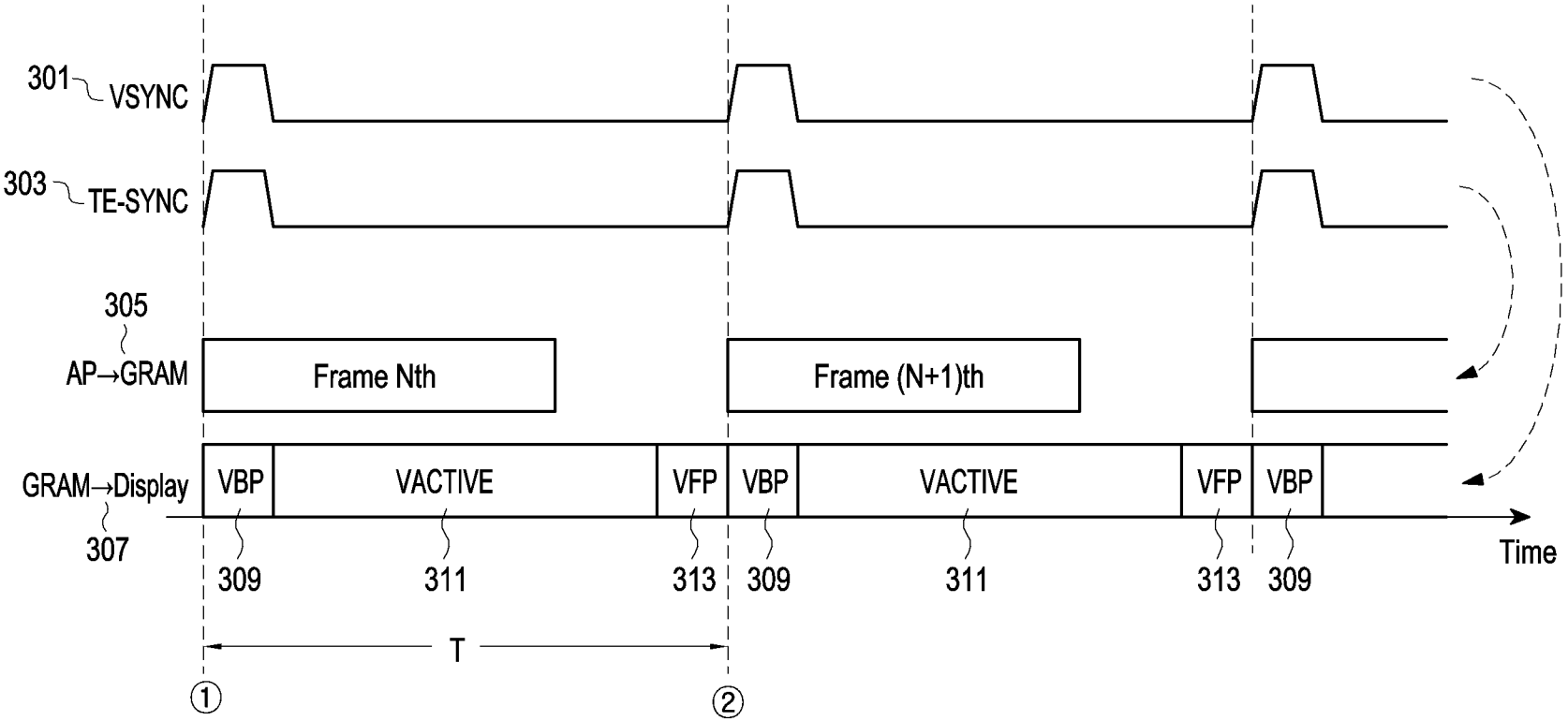
FIG. 3 is a view illustrating timing signals of an electronic device and transmission of an image frame, according to an embodiment.

FIG. 3 is a view illustrating timing signals of an electronic device (e.g., the electronic device 101 of FIG. 1) and transmission of an image frame, according to an embodiment.

As shown in FIG. 3, "AP" may refer to a processor (e.g., the processor 120 of FIG. 1), "DDI" (display driver IC) may refer to a display controller (e.g., the display controller 201 of FIG. 2), GRAM may refer to a Graphics Random Access Memory (e.g. the memory 130 of FIG. 2), and "Display" may refer to a display (e.g., the display 203 of FIG. 2).

According to an embodiment, the timing signal of the electronic device 101 includes a VSYNC signal 301 (e.g., the synchronization signal of FIG. 2) and a TE-SYNC signal 303 (e.g., first and second timing signals). According to an embodiment, the vertical axis of the VSYNC signal 301 and the TE-SYNC signal 303 may indicate the relative magnitude of the voltage values of each signal. According to an embodiment, the rising voltage values of the VSYNC signal 301 and the TE-SYNC signal 303 may not necessarily be the same.

According to an embodiment, the VSYNC signal 301 may determine the time period (or timing) of reading the image frame from the memory (e.g., the memory 130 of FIG. 1) and transmitting the image frame to the display (e.g., the display 203 of FIG. 2) by the display controller (e.g., the display controller 201 of FIG. 2).

Referring to 301 and 307 of FIG. 3, the display controller 201 may read an image frame from the memory (e.g., memory 130 of FIG. 1) based on a rise in the voltage value of the VSYNC signal 301 and transmit the image frame to the display (e.g., the display 203 of FIG. 2).

According to an embodiment, the operation period 307 of the display controller 201 may include a VBP period 309, a VACTIVE period 311, and a VFP period 313. According to an embodiment, the VBP period 309 may be a vertical back porch (VBP) period. According to an embodiment, the VFP period 313 may be a vertical front porch (VFP) period. According to an embodiment, the VACTIVE period 311 may be a scan period of the display controller 201. It will be apparent to those skilled in the art that the VACTIVE period 311 may be referred to as a read period or a scan period, or by other various terms. According to an embodiment, the display controller 201 may read an image frame from the memory (e.g., the memory 130 of FIG. 1) and transmit the image frame to the display (e.g., the display 203 of FIG. 2) in the VACTIVE period 311 (e.g., within the VACTIVE period 311). According to an embodiment, the length (time) of the VBP period 309 and/or the length (time) of the VFP period 313 may be proportional to the interval of the VSYNC signal 301 corresponding to the operation period 307 of the display controller 201. For example, the length (time) of the VBP period 309 and/or the length (time) of the VFP period 313 occupy a certain proportion of the operation period 307 of the display controller 201 and may be prolonged as the interval of the VSYNC signal 301 increases.

According to an embodiment, the TE-SYNC signal 303 may determine the time period (or timing) when the processor (e.g., the processor 120 of FIG. 1) transmits an image frame to the memory 130 (e.g., the memory 130 of the display of FIG. 2).

Referring to 303 and 305 of FIG. 3, in response to a rise in the voltage value of the TE-SYNC signal 303, the processor 120 may start to transmit an image frame (e.g., Frame Nth, Frame (N+1), . . . ) to the memory 130 at each rising timing. According to an embodiment, the processor 120 may be configured to transmit each image frame within the VACTIVE period 311 (e.g., before each VACTIVE period 311 expires) when the display controller 201 reads the image frame to prevent tearing effect from occurring.

According to an embodiment, the time period during which the processor 120 can transmit each image frame (hereinafter, referred to as "transmittable time") may be within the range from the rising timing ① of the voltage value of the TE-SYNC signal 303 to the timing ② when the VACTIVE period 311 ends. According to an embodiment, since the length of the VACTIVE period 311 within one period is proportional to the interval of the VSYNC signal 301, the transmittable time of the processor 120 may be determined according to the rising timing of the voltage value of the TE-SYNC signal 303, the length of the VACTIVE period 311 and/or the period of the VSYNC signal 301.

Referring to 301 and 303 of FIG. 3, the VSYNC signal 301 and the TE-SYNC signal 303 may be set so that their voltage values correspondingly rise and/or fall (e.g., the signals have the same intervals). According to an embodiment, the rising timing of the VSYNC signal 301 and the rising timing of the TE-SYNC signal 303 may be the same or the rising timing of the VSYNC signal 301 may be set to be different from the rising timing of the VSYNC signal 301. According to an embodiment, when the rising timing of the VSYNC signal 301 and the rising timing of the TE-SYNC signal 303 are synchronized (e.g., coincident), the transmittable time of the processor 120 may be determined according to the rising timing of the voltage value of the VSYNC signal 301, the length of the VACTIVE period 311 and/or the period of the VSYNC signal 301.

According to an embodiment, since image frames generated by the processor 120 and transmitted from the processor 120 is transmitted to the display 203 in VACTIVE periods 311 (e.g., within VACTIVE periods 311), the time taken for the image generated by the processor 120 to be output through the display 203 may be determined according to the rising timing of the voltage value of the TE-SYNC signal 303, the length of the VACTIVE period 311 and/or the interval of the VSYNC signal 301.

For convenience of description, the description focuses primarily on the VACTIVE period 311, with the VBP period 309 and the VFP period 313 omitted from the drawings below.

Figure 4A:
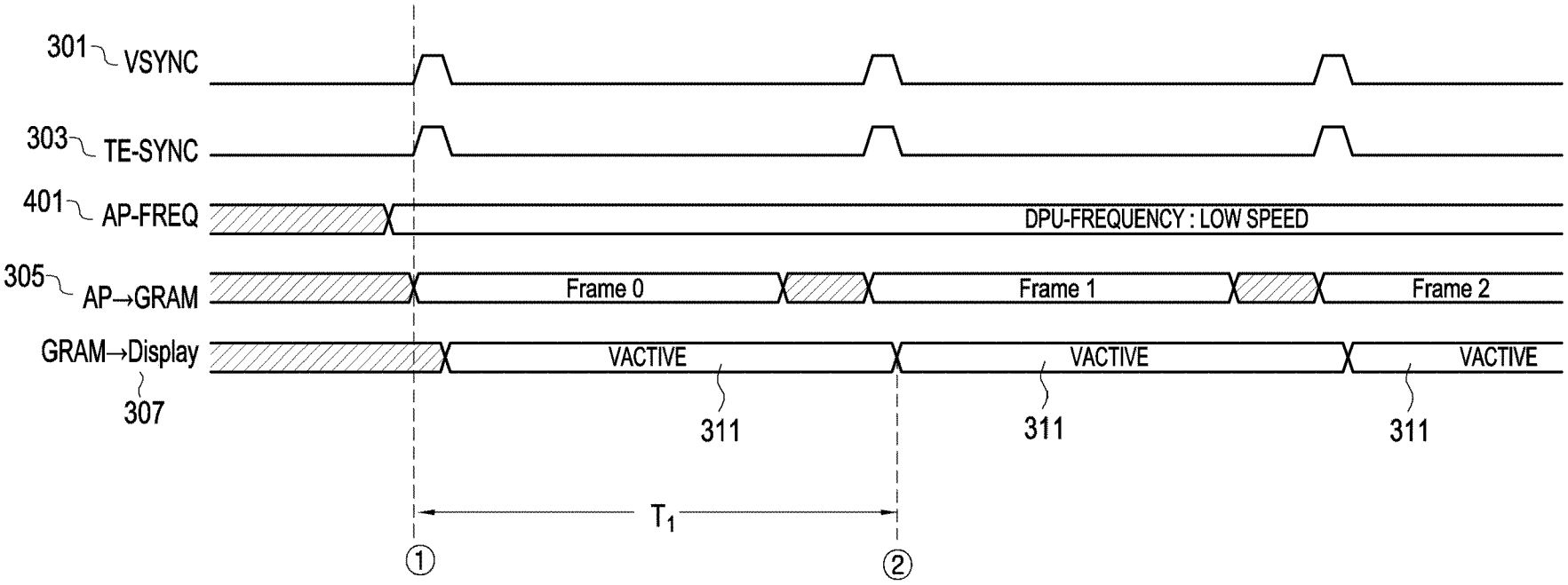
FIG. 4A is a view illustrating a first mode of an electronic device according to an embodiment.
Figure 4B:
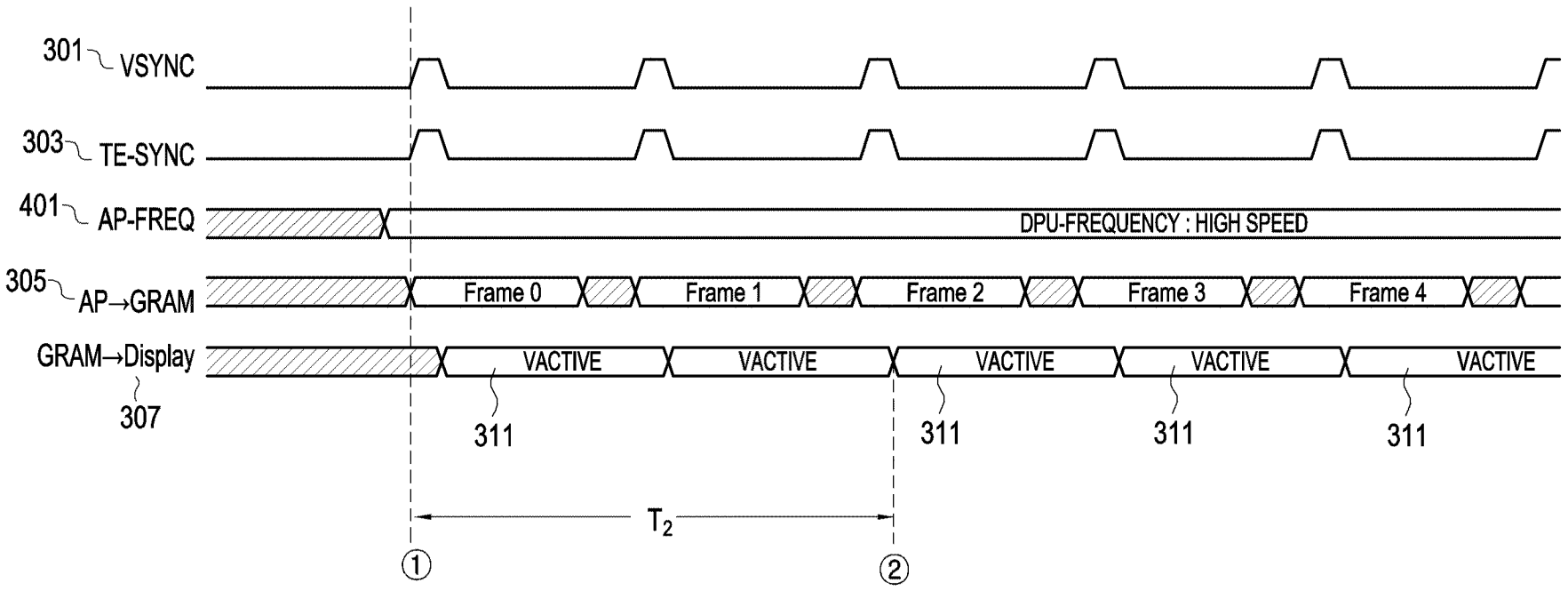
FIG. 4B is a view illustrating a second mode of an electronic device according to an embodiment.

FIG. 4A is a view illustrating a first mode of an electronic device (e.g., the electronic device 101 of FIG. 1) according to an embodiment. FIG. 4B is a view illustrating a second mode of an electronic device 101 according to an embodiment.

According to an embodiment, the first mode may be referred to as a normal driving mode. According to an embodiment, the second mode may be referred to as a high-speed driving mode. According to an embodiment, it will be apparent to those skilled in the art that the first and second modes may be referred to by other various terms.

According to an embodiment, the VSYNC signal 301 and TE-SYNC signal 303 of FIGS. 4A and 4B may be identical to the VSYNC signal 301 and TE-SYNC signal 303 of FIG. 3 unless otherwise stated. FIGS. 4A and 4B illustrate cases in which the rising timing of the voltage value of the VSYNC signal 301 and the rising timing of the voltage value of the TE-SYNC signal 303 are synchronized (e.g., coincident).

Embodiments are described below based on a comparison between FIGS. 4A and 4B. According to an embodiment, the refresh rate of the display (e.g., the display 203 of FIG. 2) may be higher in the case of FIG. 4B than in the case of FIG. 4A. For example, the refresh rate of the display 203 of FIG. 4A may be 60 Hz, and the refresh rate of the display 203 of FIG. 4B may be 120 Hz. For example, the interval of the VSYNC signal 301 of FIG. 4A may be about 16.67 ms (=1/(60 Hz)*1000), and the interval of the VSYNC signal 301 of FIG. 4B may be about 8.33 ms (=1/(120 Hz)*1000).

According to an embodiment, the processor 120 may be configured to transmit image frames within the VACTIVE periods 311 when the display controller 201 reads (or scans) the image frame to prevent tearing effect from occurring.

According to an embodiment, the AP-FREQ (application processor frequency) 401 may mean the operation frequency of the processor 120 and may be related to the operation speed of the processor 120. According to an embodiment, the operation speed may be the speed required for the processor 120 to transmit a frame within the VACTIVE period 311 of the display controller 201, and as the transmittable time of the processor 120 decreases, the operation speed required of the processor 120 may increase. According to an embodiment, the operation frequency may be the operation frequency required for the processor 120 to transmit an image frame at a specific operation speed, and the operation frequency may mean, for example, an oscillator clock frequency of the processor 120.

According to an embodiment, the operation speed and operation frequency of the processor 120 may be determined based on the interval of the VSYNC signal 301. According to an embodiment, since the processor 120 can transmit an image frame within the transmittable times t1 and t2, as the interval of the VSYNC signal 301 decreases, the transmittable time may reduce (e.g., t1>t2). Accordingly, the shorter the interval of the VSYNC signal 301 is (for example, the higher the refresh rate of the display 203 is), the higher the operation speed and operation frequency required of the processor 120 may be. For example, since the interval of the VSYNC signal 301 of FIG. 4A is about 16.67 ms and the interval of the VSYNC signal 301 of FIG. 4B is about 8.33 ms, the operation speed and operation frequency required of the processor 120 in the case of FIG. 4B may be higher than those in the case of FIG. 4A.

Comparison between FIGS. 4A and 4B is shown below.

TABLE 1

| driving mode | OSC[MHz] | VFP | Length of VACTIVE period [ms] |
|---|---|---|---|
| first mode (FIG. 4A) | OSC_NM | VFP_NM | (1000/FPS) * (VACTIVE/VTOTAL_NM) |
| second mode (FIG. 4B) | OSC_HS | VFP_HS | (1000/FPS) * (VACTIVE/VTOTAL_HS) |

When the interval of the VSYNC signal 301 of FIG. 4A is about 16.67 ms and the interval of the VSYNC signal 301 of FIG. 4B is about 8.33 ms, the values in Table 1 may be as follows.

Referring to Table 1, OSC may be the operation frequency (e.g., an oscillator frequency) of the display controller 201. For example, OSC_NM may be 48.25 MHz and OSC_HS may be 96.5 MHz.

Frame per second (FPS) may be the refresh rate of the display 203. The refresh rate of the display 203 may be a reciprocal of the interval of the VSYNC signal 301.

(VACTIVE/VTOTAL_NM) and (VACTIVE/VTOTAL_HS) may mean ratios between the VACTIVE period 311 and the total period (e.g., VBP period+VACTIVE period+VFP period) of the VSYNC signal 301. The VACTIVE period may be a period other than the VBP period (e.g., VBP period 309 in FIG. 3) and the VFP period (e.g., VFP period 313 in FIG. 3) in the VSYNC signal 301.

When the intervals of the VSYNC signals 301 of FIGS. 4A and 4B are about 16.67 ms and about 8.33 ms, respectively, the length of the VACTIVE period 311 of FIG. 4A may be about 16.5 ms (=(1/60 Hz)*(3200H)/3232H)*1000), and the length of the VACTIVE period 311 of FIG. 4B may be about 8.25 ms (=(1/120 Hz)*(3200H/3232H)*1000).

According to an embodiment, since the length (e.g., about 8.25 ms) of the VACTIVE period 311 of FIG. 4B is shorter than the length of the VACTIVE period 311 of FIG. 4A, the operation speed and operation frequency required for the processor 120 to transmit the image frame to the memory 130 within the VACTIVE period 311*a* or 311*b* may be higher in the case of FIG. 4B than in the case of FIG. 4A.

According to an embodiment, as the operation speed and operation frequency of the processor 120 and/or the display controller 201 of the electronic device 101 increases, the power consumption (or current consumption) of the electronic device 101 may increase. For example, since the operation speed and operation frequency of the processor 120 and/or the display controller 201 are higher in the case of FIG. 4B than in the case of FIG. 4A, the power consumption of the electronic device 101 may be higher in the case of FIG. 4A than the case of FIG. 4B.

Figure 5:
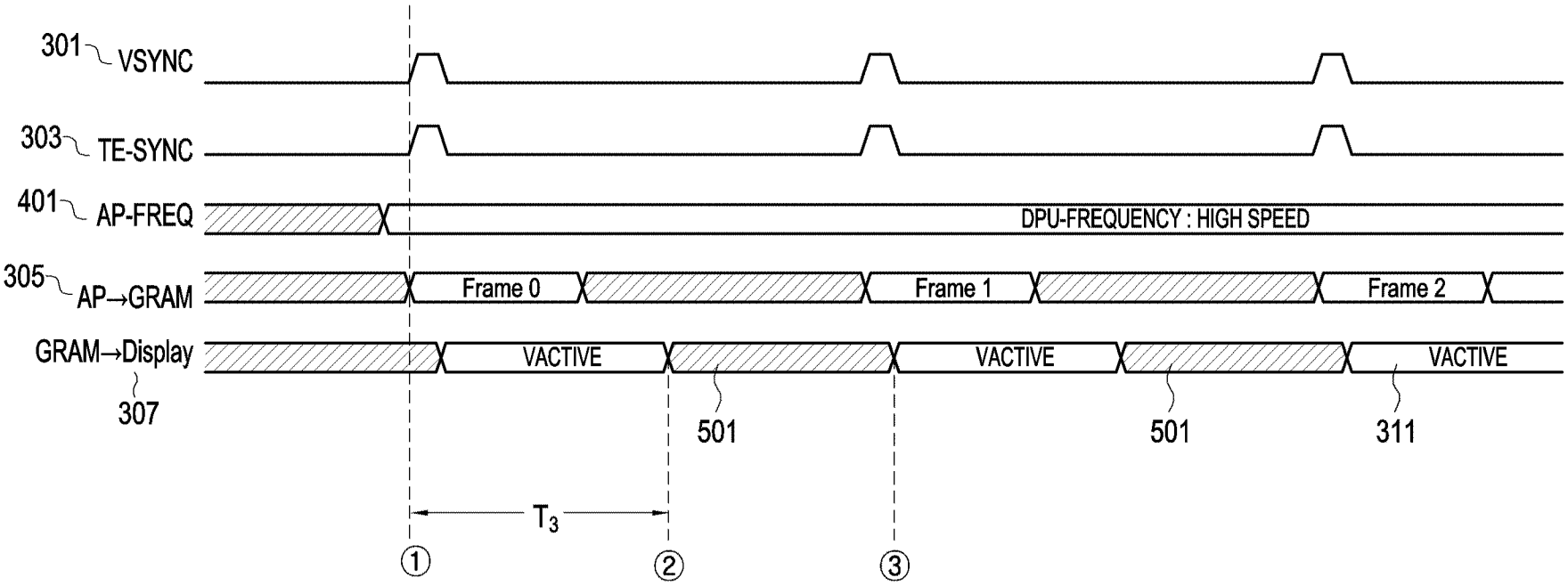
FIG. 5 is a view illustrating a third mode of an electronic device according to an embodiment.

FIG. 5 is a view illustrating a third mode of an electronic device (e.g., the electronic device 101 of FIG. 1) according to an embodiment. According to an embodiment, the third mode may be referred to as an adaptive high-speed driving mode.

According to an embodiment, the VSYNC signal 301 and TE-SYNC signal 303 of FIG. 5 may be identical to the VSYNC signal 301 and TE-SYNC signal 303 of FIG. 3 unless otherwise stated. FIG. 5 illustrates a case in which the rising timing of the voltage value of the VSYNC signal 301 and the rising timing of the voltage value of the TE-SYNC signal 303 are synchronized (e.g., coincident). According to an embodiment, in the third mode of the disclosure, the rising timing of the voltage value of the VSYNC signal 301 may not be necessarily synchronized (e.g., coincident) with the rising timing of the voltage value of the TE-SYNC signal 303.

FIG. 5 illustrates a case where the operation frequency of the display controller 201 is the same as the operation frequency of the display controller 201 in the second mode of FIG. 4B, and the refresh rate (or the interval of the VSYNC signal 301) of the display 203 is identical to the refresh rate (or the interval of VSYNC signal 301) of the display 203 in the first mode of FIG. 4A. According to an embodiment, since the operation frequency of the display controller 201 of FIG. 5 is the same as that of FIG. 4B, seamless switching between the third mode of FIG. 5 and the second mode of FIG. 4B may be possible.

According to an embodiment, since the operation frequency of the display controller 201 of FIG. 5 is the same as that of FIG. 4B, the length of the VACTIVE period 311 during which the display controller 201 reads image frames from the memory (e.g., the memory 130 of FIG. 1) and transmits the image frames to the display 203 may be the same as the length of the VACTIVE period 311 of FIG. 4B. For example, referring to the length of the VACTIVE period of Table 1, the length of the VACTIVE period 311 of FIG. 5 may be about 8.25 ms (=(1/60 Hz)*(3200H/6464H)*1000).

According to an embodiment, the AP-FREQ 401 may mean the operation speed and operation frequency of the processor 120. According to an embodiment, since the length of the VACTIVE period 311 of FIG. 5 is the same as the length of the VACTIVE period 311 of FIG. 4B, the transmittable time t3 of the processor 120 may be the same as the transmittable time t2 of FIG. 4B. According to an embodiment, since the processor 120 may transmit an image frame within the transmittable time t3, high operation speed and high operation frequency may be required for the processor 120 as in the case of FIG. 4B.

Comparison between FIGS. 4A, 4B, and 5 is shown below.

TABLE 2

| driving mode | Power consumption | Refresh rate (VSYNC signal period) | seamlessly switchable? |
|---|---|---|---|
| first mode | Low | Normal | impossible |

TABLE 2-continued

| driving mode | Power consumption | Refresh rate (VSYNC signal period) | seamlessly switchable? |
|---|---|---|---|
| (FIG. 4A) | | (normal) | |
| second mode (FIG. 4B) | High | rapid (short) | Seamlessly switchable between second mode and third mode |
| third mode (FIG. 5) | Normal | Normal (normal) | |

Comparison between FIGS. 4B and 5 reveals that in the case of FIG. 5, a blank period 501 occurs from the timing (②) when the VACTIVE period 311 corresponding to a first image frame (e.g., Frame0) expires to the timing (③) when the VACTIVE period 311 corresponding to the next image frame (e.g., Frame1) starts. According to an embodiment, the occurrence of the blank period 501 may mean that the length of the VFP period (e.g., the VFP period 313 in FIG. 3) increases. According to an embodiment, the processor 120 may be configured to transmit one image frame at a given interval corresponding to the VACTIVE period 311 of one period (e.g., one interval) so that no tearing effect occurs. According to an embodiment, although the processor 120 starts to transmit the second image frame (e.g., Frame1), which is transmitted next in order, during the blank period 501 after transmitting the first image frame (e.g., Frame0), no tearing effect may occur. For example, in the case of FIG. 5, since one operation period 307 is 6464H, the blank period 501 may be 3232H.

The refresh rate of FIG. 5 has been described above as the same as the refresh rate (e.g., 60 Hz) of FIG. 4A, but the refresh rate of FIG. 5 is not necessarily the same as that of FIG. 4A. For example, according to an embodiment, the refresh rate of FIG. 5 may be in the range from 60 Hz to 120 Hz and may be dynamically changed in the range from 60 Hz to 120 Hz.

Figure 6A:
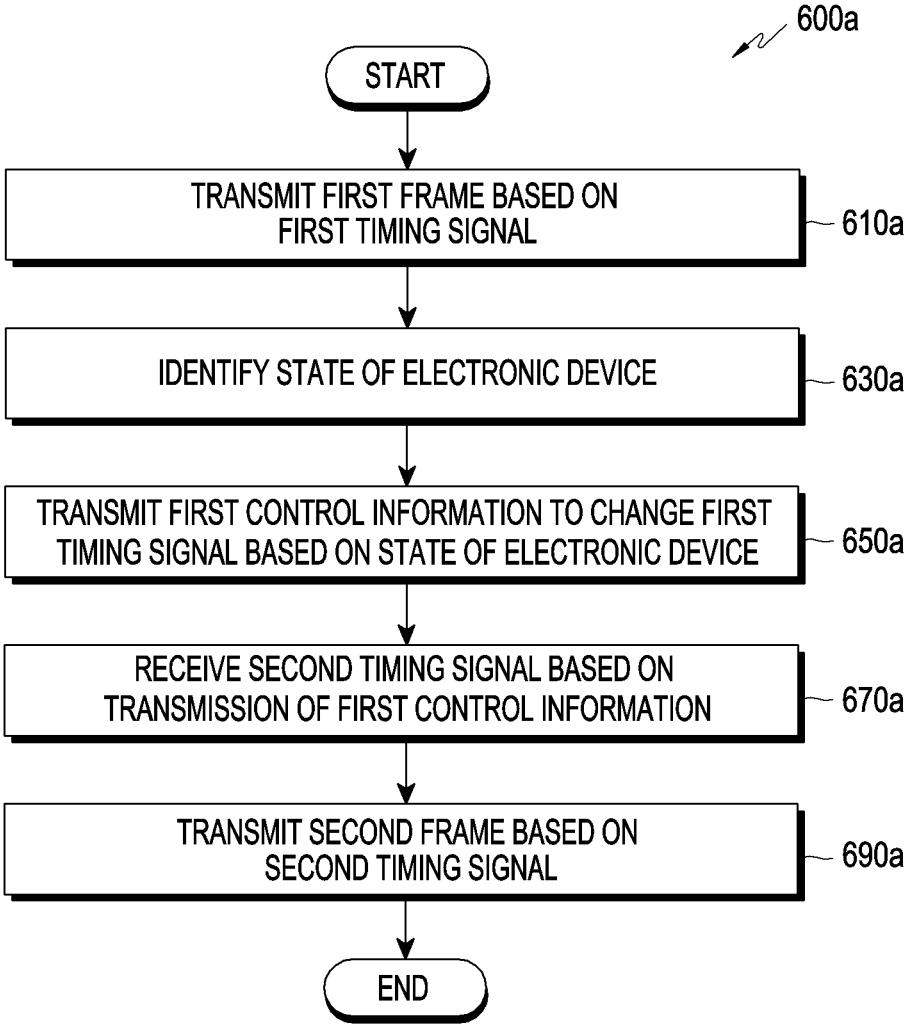
FIG. 6A is a flowchart illustrating the operation of changing a rising timing of a timing signal by an electronic device, according to an embodiment.

FIG. 6A is a flowchart 600*a* illustrating the operation of changing a rising timing of a timing signal (e.g., TE-SYNC signal 303 of FIG. 3) by an electronic device (e.g., the electronic device 101 of FIG. 1) according to an embodiment. Hereinafter, for convenience of explanation, it will be described with reference to FIGS. 3-5.

According to an embodiment, the electronic device 101 may transmit a first frame (e.g., the image frame of FIG. 3) based on the first timing signal (e.g., the TE-SYNC signal 303 of FIG. 3) in operation 610*a*. According to an embodiment, the processor (e.g., the processor 120 of FIG. 1) may transmit the first frame (e.g., the image frame of FIG. 3) to a memory (e.g., the memory 130 of FIG. 2) in response to a rise in the voltage value of the first timing signal (e.g., the TE-SYNC signal 303 of FIG. 3). According to an embodiment, the time during which the processor 120 can transmit the first image frame (e.g., the image frame of FIG. 3) may be within the range from the rising timing (e.g., ① of FIG. 5) of the voltage value of the first timing signal (e.g., the TE-SYNC signal 303 of FIG. 3) to the timing (e.g., ② of FIG. 5) when the VACTIVE period (e.g., the VACTIVE period 311 of FIG. 3) ends. According to an embodiment, the transmittable time of the processor 120 may be determined depending on the rising timing (e.g., ① in FIG. 5) of the voltage value of the first timing signal (e.g., TE-SYNC signal 303 in FIG. 3), the length of the VACTIVE period (e.g., the VACTIVE period 311 of FIG. 3) and/or the interval of the synchronization signal (e.g., the VSYNC signal 301 of FIG. 3).

According to an embodiment, the electronic device 101 may identify the state of the electronic device 101 in operation 630*a*. For example, the state of the electronic device 101 may include at least one of the type of application(s) executed on the electronic device 101, the content of the screen (e.g., the execution screen of the application) displayed on the display (e.g., the display 203 of FIG. 2) of the electronic device 101, the type of user input received, and the temperature of the electronic device 101.

According to an embodiment, in operation 650*a*, the electronic device 101 may transmit first control information to change the timing of the first timing signal (e.g., the TE-SYNC signal 303 of FIG. 3) based on the state of the electronic device 101. According to an embodiment, the processor 120 may transmit, to the display controller 201, first control information to change the timing of the first timing signal (e.g., the TE-SYNC signal 303 of FIG. 3) based on the state of the electronic device 101. According to an embodiment, the first control information may include information for changing the rising timing (e.g., ① in FIG. 5) of the voltage value of the first timing signal (e.g., TE-SYNC signal 303 of FIG. 3) for every period of the synchronization signal (e.g., VSYNC signal 301 of FIG. 3). For example, referring to FIG. 5, when the operation period (e.g., the operation period 307 of FIG. 3) of the display controller 201 is 6464H, the first control information may include information about the change time to push back or bring forward the rising timing (e.g., ① of FIG. 5) of the voltage value of the first timing signal (e.g., the TE-SYNC signal 303 of FIG. 3) within the blank period 501 of 3232H. For example, the information about the change time may include information about the change value (unit: H or ms) corresponding to the change time and/or the length ratio of the change time to the blank period (e.g., the blank period 501 of FIG. 5). According to an embodiment, the processor 120 may determine the change time to bring forward or push back the rising timing (e.g., ① of FIG. 5) of the voltage value of the first timing signal (e.g., the TE-SYNC signal 303 of FIG. 3) based on the identified state of the electronic device 101.

According to an embodiment, the processor 120 may determine whether the identified state of the electronic device 101 is a state in which high responsiveness is required (or allowed) or a state in which low power consumption is required (or allowed). According to an embodiment, responsiveness may refer to the time it takes for data (e.g., image frame) generated by the processor 120 in response to reception of a user input or operation of the application to be output through the display 203. For example, as the time taken for the data (e.g., an image frame) generated by the processor 120 to be output through the display 203 reduces, the responsiveness of the electronic device 101 may be said to be higher. According to an embodiment, power consumption may mean the power consumption of the processor 120 and/or the display controller 201. According to an embodiment, the state in which low power consumption is required (or allowed) may correspond to as a state in which high responsiveness is not required (or allowed).

According to an embodiment, the processor 120 may identify the type of the application executed on the electronic device 101 and determine whether the identified state of the electronic device 101 is a state in which high responsiveness is required (or allowed) or a state in which low power consumption is required (or allowed). According to an embodiment, the electronic device 101 may determine that, as the data (e.g., image frame) generated per unit time according to the operation of the executed application increases (e.g., as the frame rate increases), the generated data (e.g., image frame) needs to be output via the display 203 within a shorter time and high responsiveness is required. According to an embodiment, whether the executed application is an application requiring high responsiveness may be preset. For example, when the application package distributed by the application developer includes information indicating whether the application requires high responsiveness or information about the operation speed and/or operation frequency of the processor 120 required for the operation of the application, the processor may determine whether the executed application is an application requiring high responsiveness based on the information.

According to an embodiment, the processor 120 may determine whether the identified state of the electronic device 101 is a state in which high responsiveness is required (or allowed) or a state in which low power consumption is required (or allowed) based on the content of the screen (e.g., the application execution screen) displayed on the display 203 of the electronic device 101. For example, when a video having a high frame rate is being output through the display 203, the processor 120 may determine that it is in the state where high responsiveness is required. For example, when a rotation of the display mode of the display 203 (e.g., a switch between a landscape mode and a portrait mode) is detected, the processor 120 may determine that it is in the state in which high responsiveness is required. For example, if the screen displayed on the display 203 does not change for a preset time or more, the processor 120 may determine that it is in the state where the low power consumption is required (or allowed).

According to an embodiment, the processor 120 may determine whether the identified state of the electronic device 101 is a state in which high responsiveness is required (or allowed) or a state in which low power consumption is required (or allowed), based on the type of the received user input. For example, when the received user input is an input received using a stylus pen, the processor 120 may determine that it is in the state where high responsiveness is required. For example, upon detecting a removal of the stylus pen from the housing of the electronic device 101, the processor 120 may determine that it is in the state where high responsiveness is required. For example, when a short-range wireless communication signal (e.g., a signal received through Bluetooth communication) is detected from the stylus pen, the processor 120 may determine that high responsiveness is required. For example, upon receiving the user's input of scrolling the screen, the processor 120 may determine that it is in the state where high responsiveness is required. For example, upon receiving a predetermined number of (or more) inputs from the user within a predetermined time, the processor 120 may determine that it is in the state where high responsiveness is required. For example, when no input is received from the user within a predetermined time, the processor 120 may determine that it is in the state where low power consumption is required (or allowed).

According to an embodiment, the processor 120 may determine whether the identified state of the electronic device 101 is a state in which high responsiveness is required (or allowed) or a state in which low power consumption is required (or allowed) based on the temperature of the electronic device 101. For example, the temperature of the electronic device 101 may be the temperature sensed for at least one component (e.g., the processor 120 or the display 203) of the electronic device 101. In one example, upon detecting when the temperature of the electronic device 101 exceeds a predetermined temperature (e.g., 50° C.), the processor 120 may determine that it is in the state where low power consumption is required. In another example, upon detecting when the temperature of the electronic device 101 is less than a predetermined temperature (e.g., 20° C.), the processor 120 may determine that it is in the state where high responsiveness is allowed or high power consumption is allowed.

According to an embodiment, the processor 120 may determine the change time to bring forward or push back the rising timing (e.g., ① of FIG. 5) of the voltage value of the timing signal (e.g., the TE-SYNC signal 303 of FIG. 3), as compared with the original timing signal (e.g., the TE-SYNC signal 303 of FIG. 3) based on whether the identified state of the electronic device 101 is the state where high responsiveness is required (or allowed) or low power consumption is required (or allowed). According to an embodiment, the processor 120 may determine the change time to bring forward the rising timing (e.g., ① of FIG. 5) of the voltage value of the timing signal (e.g., the TE-SYNC signal 303 of FIG. 3) when it is determined that the identified state of the electronic device 101 is the state where high responsiveness is required (or allowed) or high power consumption is required (or allowed). According to an embodiment, the processor 120 may determine the change time to push back the rising timing (e.g., ① of FIG. 5) of the voltage value of the timing signal (e.g., the TE-SYNC signal 303 of FIG. 3) when it is determined that the identified state of the electronic device 101 is the state where low responsiveness is required (or allowed) or low power consumption is required (or allowed).

According to an embodiment, the processor 120 may generate first control information including the determined change time and transmit the generated first control information to the display controller 201.

According to an embodiment, in operation 670*a*, the electronic device 101 may receive a second timing signal after transmitting the first control information. According to an embodiment, the processor 120 may receive the second timing signal from the display controller 201. According to an embodiment, the second timing signal may be different in rising timing of voltage value from the first timing signal (e.g., the TE-SYNC signal 303 of FIG. 3). For example, the rising timing of the voltage value of the second timing signal may come earlier or later than the rising timing (e.g., ① in FIG. 5) of the voltage value of the first timing signal (e.g., TE-SYNC signal 303 in FIG. 3). For example, when the first timing signal is the TE-SYNC signal 303-1 of FIG. 8A, the second timing signal may be the TE-SYNC signal 303-2 of FIG. 8A. In this example, the rising timing of the second timing signal may be the second rising timing (①-2) of FIG. 8A. In another example, when the first timing signal is the TE-SYNC signal 303-2 of FIG. 8A, the second timing signal may be the TE-SYNC signal 303-1 of FIG. 8A. In this example, the rising timing of the second timing signal may be the first rising timing (①-1) of FIG. 8A.

According to an embodiment, in operation 690*a*, the electronic device 101 may transmit a second frame (e.g., the image frame of FIG. 3) based on the second timing signal. According to an embodiment, the processor (e.g., the processor 120 of FIG. 1) may transmit the second frame (e.g., the image frame of FIG. 3) to the memory (e.g., the memory 130 of FIG. 2) in response to a rise in the voltage value of the second timing signal.

Figure 6B:
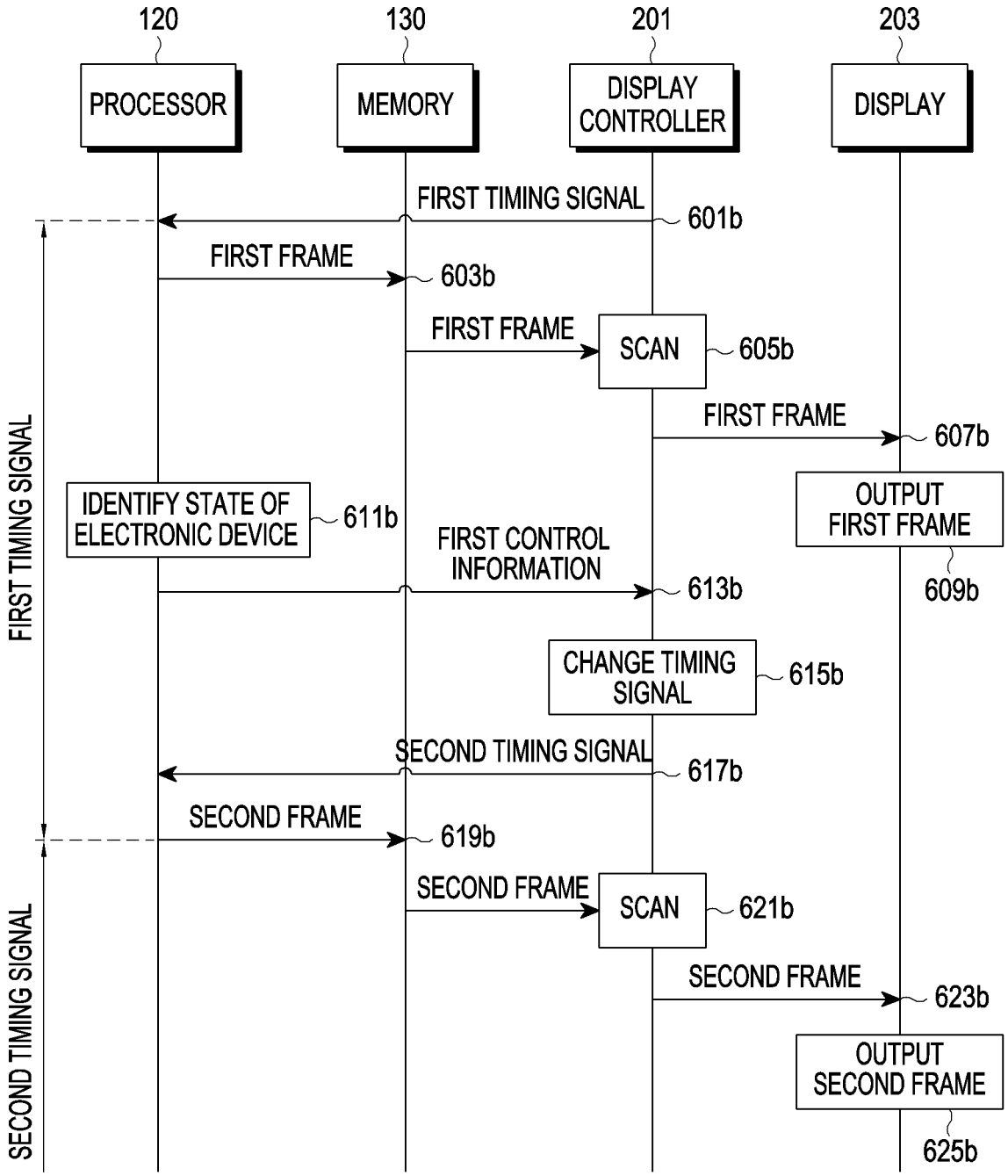
FIG. 6B is a flowchart illustrating operations of a processor, a display controller, and/or a display according to an embodiment.

FIG. 6B is a flowchart 600*b* illustrating operations of the processor 120, the display controller 201, and/or the display 203 according to an embodiment.

According to an embodiment, the processor 120 may receive a first timing signal (e.g., the TE-SYNC signal 303 of FIG. 3) from the display controller 201 in operation 601*b*.

According to an embodiment, in operation 603*b*, the processor 120 may transmit a first frame (e.g., the image frame of FIG. 3) to the memory 130. According to an embodiment, transmission of the first frame (e.g., the image frame of FIG. 3) may be performed in response to a rise in the voltage value of the first timing signal (e.g., the TE-SYNC signal 303 of FIG. 3).

According to an embodiment, the display controller 201 may scan the first frame (e.g., the image frame of FIG. 3) from the memory 130 in operation 605*b*. According to an embodiment, scanning of the first frame (e.g., the image frame of FIG. 3) may be performed in response to a rise in the voltage value of the VSYNC signal (e.g., the VSYNC signal 301 of FIG. 3).

According to an embodiment, the display controller 201 may transmit the first frame (e.g., the image frame of FIG. 3) to the display 203 in operation 607*b*.

According to an embodiment, the display 203 may output the first frame (e.g., the image frame of FIG. 3) in operation 609*b*. According to an embodiment, the first frame (e.g., the image frame of FIG. 3) may be visually output as an image (e.g., be displayed) through the display 203.

According to an embodiment, the processor 120 may identify the state of the electronic device 101 in operation 611*b*. According to an embodiment, operation 609*b* is not necessarily performed after the above-described operations are performed, but operation 609 may rather be performed before and/or while any one of the above-described operations is performed.

According to an embodiment, the processor 120 may transmit first control information to the display controller 201 in operation 613*b*.

According to an embodiment, the display controller 201 may change the timing signal (e.g., the TE-SYNC signal 303 of FIG. 3) in operation 615*b*. According to an embodiment, the display controller 201 may identify information (e.g., information for changing (or adjusting) the rising timing (e.g., ① in FIG. 5) of the voltage value of the first timing signal (e.g., the TE-SYNC signal 303 of FIG. 3)) included in the received first control information. According to an embodiment, the display controller 201 may generate a second timing signal having a different rising timing of voltage value from the rising timing of the voltage value of the first timing signal (e.g., the TE-SYNC signal 303 of FIG. 3), based on the identified information included in the received first control information.

According to an embodiment, the processor 120 may receive the second timing signal from the display controller 201 in operation 617*b*. According to an embodiment, the processor 120 may receive the second timing signal generated to have a different rising timing of voltage value from the rising timing of the voltage value of the first timing signal (e.g., the TE-SYNC signal 303 of FIG. 3).

According to an embodiment, in operation 619*b*, the processor 120 may transmit a second frame (e.g., the image frame of FIG. 3) to the memory 130. According to an embodiment, transmission of the second frame (e.g., the image frame of FIG. 3) may be performed in response to the rise in the voltage value of the second timing signal.

According to an embodiment, the display controller 201 may scan the second frame (e.g., the image frame of FIG. 3) from the memory 130 in operation 621*b*. According to an embodiment, scanning (or reading) of the second frame (e.g., the image frame of FIG. 3) may be performed in response to a rise in the voltage value of the VSYNC signal (e.g., the VSYNC signal 301 of FIG. 3).

According to an embodiment, the display controller 201 may transmit the second frame (e.g., the image frame of FIG. 3) to the display 203 in operation 623*b*.

According to an embodiment, the display 203 may output the second frame (e.g., the image frame of FIG. 3) in operation 625*b*. According to an embodiment, the second frame (e.g., the image frame of FIG. 3) may be visually output as an image) (e.g., be displayed) through the display 203.

According to an embodiment, the processor 120 may perform operations 603*b* and 619*b* at different operation speeds. The respective voltage values of the first timing signal (e.g., the TE-SYNC signal 303 in FIG. 3) and the second timing signal rise at different times, so that the operation speed and/or operation frequency required for the processor 120 may differ. This is described below in further detail.

Figure 7:
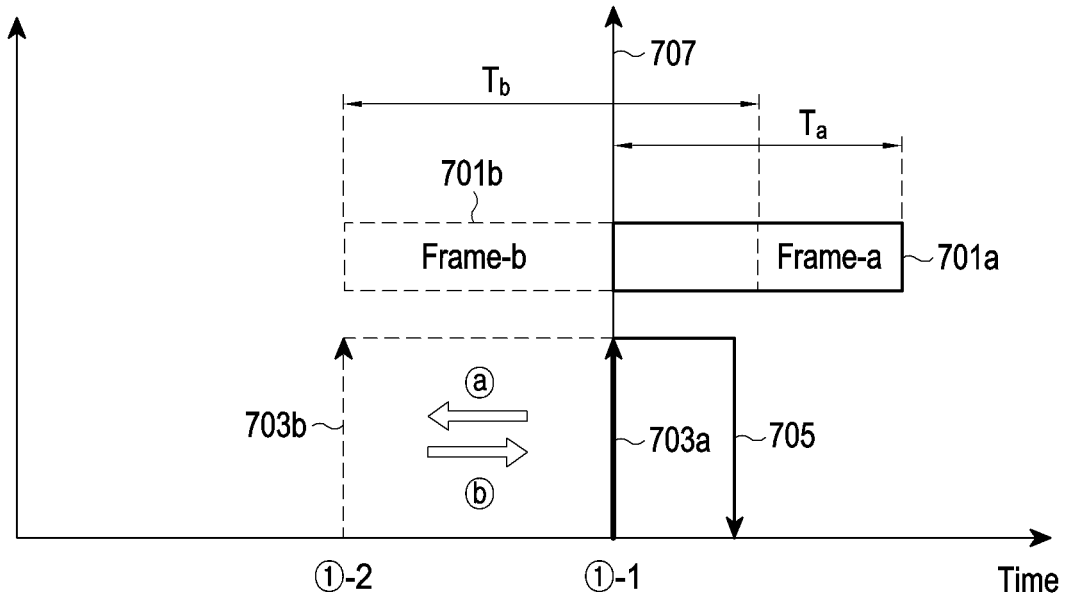
FIG. 7 is a view illustrating the operation of changing a rising timing of a timing signal by an electronic device, according to an embodiment.

FIG. 7 is a view illustrating the operation of changing a rising timing of a timing signal (e.g., TE-SYNC signal 303 of FIG. 3) by an electronic device (e.g., the electronic device 101 of FIG. 1) according to an embodiment.

Referring to FIG. 7, the voltage value of a timing signal (e.g., TE-SYNC signal 303 of FIG. 3) may rise (703*a*) at a first rising timing (①-1) or may rise (703*b*) at a second rising timing (①-2). According to an embodiment, the rising timing of the timing signal (e.g., the TE-SYNC signal 303 of FIG. 3) may be changed from the first rising timing (①-1) to the second rising timing (①-2) (e.g., changed in direction ⓐ in FIG. 7) or from the second rising timing (①-2) to the first rising timing (①-1) (e.g., changed in direction ⓑ in FIG. 7), by the display controller (e.g., the display controller 201 of FIG. 2), based on the first control information. Although FIG. 7 illustrates that the timing when the voltage value of the VSYNC signal (e.g., the VSYNC signal 301 of FIG. 3) rises (707) is the same as the timing (①-1) of the voltage value when the timing signal (e.g., the TE-SYNC signal 303 of FIG. 3) rises (703*a*), the rising timing of the VSYNC signal may be between ①-1 and ①-2.

According to an embodiment, an image frame ("Frame-a") 701*a* (e.g., the image frame of FIG. 3) may be transmitted to the memory (e.g., the memory 130 of FIG. 2) by the processor (e.g., the processor 120 of FIG. 1) during a first transmission time Ta. According to an embodiment, an image frame ("Frame-b") 701*b* (e.g., the image frame of FIG. 3) may be transmitted to the memory 130 by the processor 120 during a second transmission time Tb. As will be described in more detail in connection with FIG. 8, as the rising timing of the timing signal (e.g., TE-SYNC signal 303 of FIG. 3) changes, the time period within the processor 120 may transmit an image frame (e.g., the image frame of FIG. 3) (hereinafter, "transmittable time") may be changed. Accordingly, the operation speed and/or the operation frequency required for the processor 120 may be changed, and the power consumed by the processor 120 may be changed.

According to an embodiment, the electronic device 101 may identify the state of the electronic device 101 and, based on the identified state of the electronic device 101, the rising timing may be changed from the first rising timing (①-1) to the second rising timing (①-2) (e.g., changed in direction ⓐ in FIG. 7) or from the second rising timing (①-2) to the first rising timing (①-1) (e.g., changed in direction in FIG.

7). For example, upon determining that the identified state of the electronic device 101 is the state where high responsiveness is required (or allowed) or high power consumption is required (or allowed), the electronic device 101 may change (e.g., in direction ⓐ of FIG. 7) the rising timing of the timing signal (e.g., the TE-SYNC signal 303 of FIG. 3) from the first rising timing (①-1) to the second rising timing (①-2). For example, upon determining that the identified state of the electronic device 101 is the state where low responsiveness is required (or allowed) or low power consumption is required (or allowed), the electronic device 101 may change (e.g., in direction of FIG. 7) the rising timing of the timing signal (e.g., the TE-SYNC signal 303 of FIG. 3) from the second rising timing (①-2) to the first rising timing (①-1).

According to an embodiment, the timing when the timing signal (e.g., the TE-SYNC signal 303 of FIG. 3) falls (705) may remain the same regardless of whether the rising timing is at the first rising timing (①-1) or at the second rising timing (①-2). For example, the falling timing of the timing signal (e.g., the TE-SYNC signal 303 of FIG. 3) may correspond to the falling timing of the VSYNC signal (e.g., the VSYNC signal 301 of FIG. 3).

According to an embodiment, unlike in the case shown in FIG. 7, the falling timing of the timing signal (e.g., the TE-SYNC signal 303 of FIG. 3) may differ depending on whether the rising timing is at the first rising timing (①-1) or at the second rising timing (①-2). For example, in a case that the timing signal rises (703*a*) at the first rising timing (①-1) and in a case that the timing signal rises (703*b*) at the second rising timing (①-2), the duration time interval during which the voltage value of the timing signal (e.g., the TE-SYNC signal 303 of FIG. 3) is relatively high may remain the same, but the falling timing of the timing signal (e.g., the TE-SYNC signal 303 of FIG. 3) may differ between a case that the timing signal rises (703*a*) at the first rising timing (①-1) and a case that the timing signal rises (703*b*) at the second rising timing (①-2).

Table 3 shows comparison between a case where the rising timing of the voltage value of the timing signal (e.g., the TE-SYNC signal 303 of FIG. 3) is not synchronized with the rising timing of the voltage value of the synchronization signal (e.g., the VSYNC signal 301 of FIG. 3) ("asynchronous TE") and a case where the rising timing of the voltage value of the timing signal (e.g., the TE-SYNC signal 303 of FIG. 3) is synchronized with the rising timing of the voltage value of the synchronization signal (e.g., the VSYNC signal 301 of FIG. 3) ("synchronous TE"). For example, the case where the rising timing of the voltage value of the timing signal (e.g., the TE-SYNC signal 303 of FIG. 3) is not synchronized with the rising timing of the voltage value of the synchronization signal (e.g., the VSYNC signal 301 of FIG. 3) ("asynchronous TE") may be, e.g., a case where the rising timing of the voltage value of the timing signal (e.g., the TE-SYNC signal 303 of FIG. 3) is the second rising timing (①-2). For example, the case where the rising timing of the voltage value of the timing signal (e.g., the TE-SYNC signal 303 of FIG. 3) is synchronized with the rising timing of the voltage value of the synchronization signal (e.g., the VSYNC signal 301 of FIG. 3) ("synchronous TE") may be, e.g., a case where the rising timing of the voltage value of the timing signal (e.g., the TE-SYNC signal 303 of FIG. 3) is the first rising timing (①-1).

TABLE 3

| Scenario | Layers | asynchronous TE AP-FREQ | synchronous TE AP-FREQ |
|---|---|---|---|
| Camera preview | 5 | 200 | 400 |
| Video player(landscape) | 3 | 400 | 666 |
| Video player(portrait) | 3 | 200 | 400 |
| Youtu e(landscape) | 3 | 200 | 400 |
| Youtube(portrait) | 6 | 400 | 666 |

Referring to Table 3, AP-FREQ may mean the operation frequency of the processor 120. The values of AP-FREQ may mean relative magnitudes of the operation frequency of the processor 120. "Layers" may mean the number of layers of a screen displayed on the display 203 in each "Scenario". "Camera preview" may refer to a case in which a camera application is being executed. "Video player" may refer to a case where a video application is running. "Youtube" may refer to a case in which the YouTube application is running. "landscape" and "portrait" may refer to cases where the display mode of the display 203 is the landscape mode or the portrait mode, respectively.

Referring back to Table 3, it can be shown that compared to "synchronous TE," the operation frequency of the processor 120 is relatively smaller in the case of "asynchronous TE." This may mean that as the rising timing of the voltage value of the timing signal (e.g., the TE-SYNC signal 303 of FIG. 3) is changed, the operation frequency of the processor 120 may be reduced, as described above in connection with FIG. 7. Thus, the power consumption of the processor 120 may be reduced.

Figure 8A:
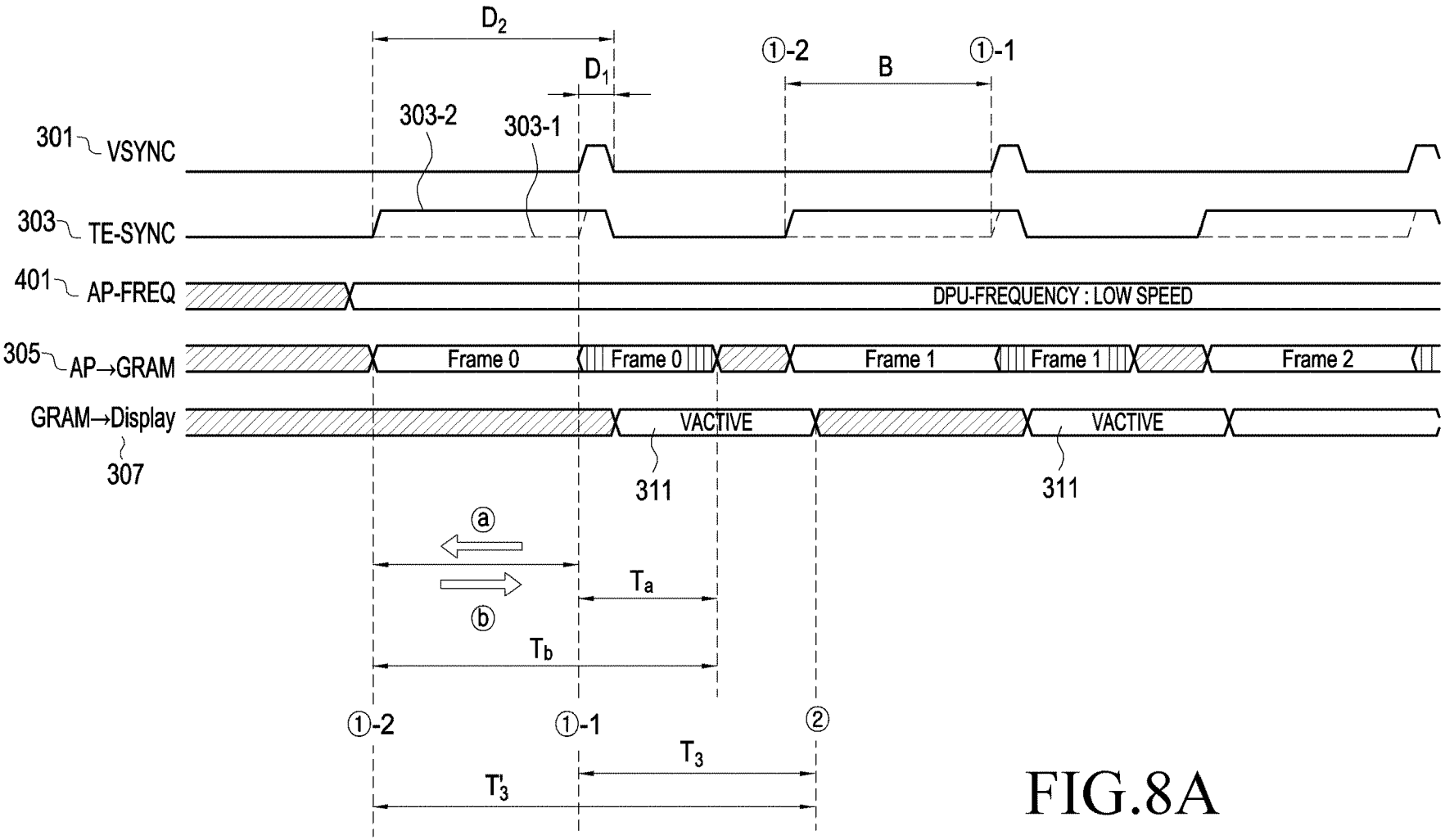
FIG. 8A is a view illustrating an example in which a rising timing of a timing signal is changed according to an embodiment.

FIG. 8A is a view illustrating an example in which a rising timing of a timing signal (e.g., the TE-SYNC signal 303) is changed according to an embodiment. Embodiments are described below with reference to FIGS. 8A and 5 and/or 7.

According to an embodiment, the first timing signal (e.g., TE-SYNC signal 303-1) may be a signal whose voltage value periodically rises at each first rising timing (①-1), and the rising state is maintained during the first duration time D1. Referring to FIG. 5, the first timing signal (e.g., TE-SYNC signal 303-1) may be the same as the timing signal of FIG. 5 (e.g., TE-SYNC signal 303 of FIG. 5).

According to an embodiment, the second timing signal (e.g., TE-SYNC signal 303-2) may be a signal whose voltage value periodically rises at each second rising timing (①-2), and the rising state is maintained during the second duration time D2. Compared with the first timing signal (e.g., TE-SYNC signal 303-1), the second timing signal (e.g., TE-SYNC signal 303-2) may have a different voltage value rising timing from the first timing signal (e.g., the TE-SYNC signal 303-1).

According to an embodiment, the processor (e.g., the processor 120 of FIG. 1) may control the display controller (e.g., the display controller 201 of FIG. 2) to change the timing signal (e.g., the TE-SYNC signal 303) from the first timing signal (e.g., the TE-SYNC signal 303-1) to the second timing signal (e.g., the TE-SYNC signal 303-2) (e.g., in direction ⓐ of FIG. 7) or from the second timing signal (e.g., the TE-SYNC signal 303-2) to the first timing signal (e.g., the TE-SYNC signal 303-1) (e.g., in direction ⓑ of FIG. 7), based on the state of the electronic device (e.g., the electronic device 101 of FIG. 1).

Although described below is an example in which the processor (e.g., the processor 120 of FIG. 1) may control the display controller (e.g., the display controller 201 of FIG. 2)

to change the timing signal (e.g., the TE-SYNC signal 303) from the first timing signal (e.g., the TE-SYNC signal 303-1) to the second timing signal (e.g., the TE-SYNC signal 303-2) (e.g., in direction ⓐ of FIG. 7) based on the state of the electronic device (e.g., the electronic device 101 of FIG. 1), the same description may be applied even when the processor controls the display controller 201 to change the timing signal (e.g., the TE-SYNC signal 303) from the second timing signal (e.g., the TE-SYNC signal 303-2) to the first timing signal (e.g., the TE-SYNC signal 303-2) (e.g., in direction ⓑ of FIG. 7).

According to an embodiment, the processor 120 may transmit the image frame (e.g., the image frame of FIG. 3) to the memory 130 based on the timing signal (e.g., the TE-SYNC signal 303).

According to an embodiment, the transmittable time during which the processor 120 can transmit the image frame (e.g., the image frame of FIG. 3) may be within the range from the rising timing (e.g., ① of FIG. 5) of the voltage value of the timing signal (e.g., the TE-SYNC signal 303) to the timing (e.g., ② of FIG. 5) when the VACTIVE period 311 ends. For example, when the timing signal (e.g., the TE-SYNC signal 303) is the first timing signal (e.g., the TE-SYNC signal 303-1), the transmittable time of the processor 120 may be smaller than or equal to the time T3 from the rising timing (①-1) of the voltage value of the first timing signal (e.g., the TE-SYNC signal 303-1) to the time ② when the VACTIVE period 311 ends. For example, when the timing signal (e.g., the TE-SYNC signal 303) is the second timing signal (e.g., the TE-SYNC signal 303-2), the transmittable time of the processor 120 may be smaller than or equal to the time T3' from the rising timing (①-2) of the voltage value of the first timing signal (e.g., the TE-SYNC signal 303-2) to the time ② when the VACTIVE period 311 ends.

According to an embodiment, the processor 120 may transmit the image frame (e.g., the image frame of FIG. 3) to the memory 130 during a time period equal to or shorter than the transmittable time. For example, when the timing signal (e.g., the TE-SYNC signal 303) is the first timing signal (e.g., the TE-SYNC signal 303-1), the processor 120 may transmit the image frame (e.g., the image frame of FIG. 3) to the memory 130 during the first transmission time Ta. For example, when the timing signal (e.g., the TE-SYNC signal 303) is the second timing signal (e.g., the TE-SYNC signal 303-2), the processor 120 may transmit the image frame (e.g., the image frame of FIG. 3) to the memory 130 during the second transmission time Tb. According to an embodiment, the first transmission time Ta and the second transmission time Tb may be less than or equal to T3 and T3', respectively.

According to an embodiment, the transmission time during which the processor 120 transmits the image frame may be changed from the first transmission time Ta to the second transmission time Tb as the timing signal (e.g., the TE-SYNC signal 303) is changed from the first timing signal (e.g., the TE-SYNC signal 303-1) to the second timing signal (e.g., the TE-SYNC signal 303-2).

According to an embodiment, the AP-FREQ 401 may mean the operation speed and operation frequency of the processor 120. According to an embodiment, the operation speed and/or operation frequency required for the processor 120 may be reduced as the transmission time is changed (e.g., increased) from the first transmission time Ta to the second transmission time Tb.

According to an embodiment, the power consumed by the processor 120 may decrease as the operation speed and/or the operation frequency required for the processor 120 changes (e.g., decreases). Similarly, as the timing signal (e.g., the TE-SYNC signal 303) is changed from the second timing signal (e.g., the TE-SYNC signal 303-2) to the first timing signal (e.g., the TE-SYNC signal 303-1), the transmission time of the processor 120 may be reduced, the operation speed and/or operation frequency required for the processor 120 may be increased, and the power consumption by the processor 120 may be increased.

According to an embodiment, the second rising timing (①-2) of the second timing signal (e.g., the TE-SYNC signal 303-2) may come a change time B (=Tb−Ta) earlier than the first rising timing (①-1) of the first timing signal (e.g., the TE-SYNC signal 303-1). As will be described below in more detail in FIG. 9, the change time B may be less than or equal to the length of the blank period 501. According to an embodiment, the length of the blank period 501 may correspond to an increased length of the VFP period (e.g., the VFP period 313 of FIG. 3). For example, the length of the blank period 501 may be 3232H. According to an embodiment, the length of the change time B may be determined according to the first control information. According to an embodiment, the first control information may include information about a change value (unit: H or ms) corresponding to the change time B and/or the length ratio of the change time to the blank period 501. For example, the first control information may include information about the change time B (e.g., 4 ms) that is less than or equal to the time length (e.g., 8.25 ms) of the blank period 501. For example, the first control information may include information about a length ratio (e.g., 50%) of the change time B to the length (e.g., 3232H) of the blank period 501.

According to an embodiment, as the rising timing of the timing signal (e.g., TE-SYNC signal 303) is changed from the first rising timing (①-1) to the second rising timing (①-2), the operation speed and/or operation frequency required for the processor 120 may be decreased, and power consumption of the processor 120 may be decreased proportional to the change time B.

Figure 8B:
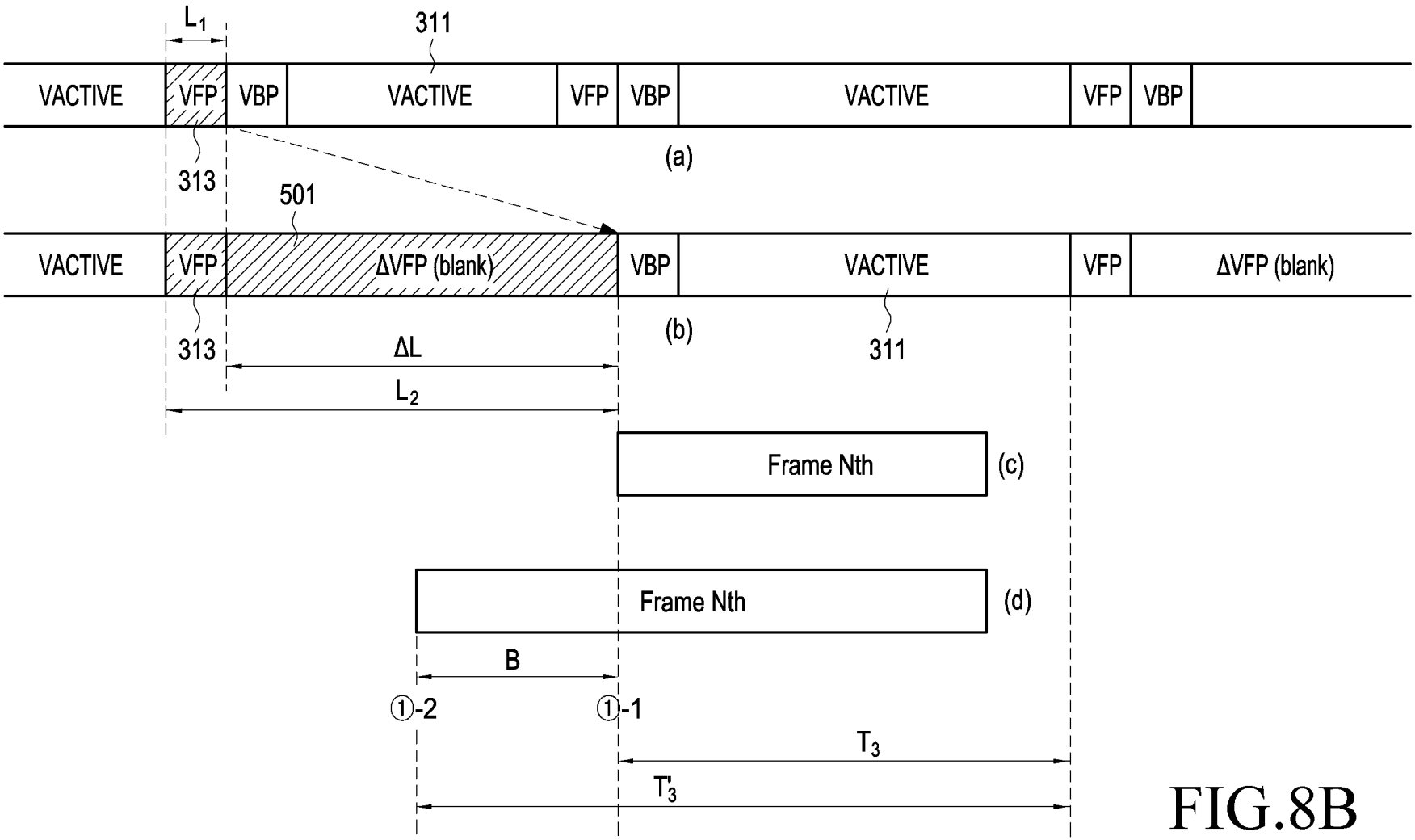
FIG. 8B is a view illustrating an example in which a transmittable time of an image frame is changed according to an embodiment.

FIG. 8B is a view illustrating an example in which a transmittable time of an image frame (e.g., the image frame of FIG. 3) is changed according to an embodiment.

(a) of FIG. 8B shows the operation period of the display controller (e.g., the display controller 201 of FIG. 2) when the refresh rate of the display (e.g., the display 203 of FIG. 2) is a first refresh rate. For example, the first refresh rate may be 120 Hz.

(b) of FIG. 8B shows the operation period of the display controller 201 when the refresh rate of the display 203 is a second refresh rate (e.g., 60 Hz). The second refresh rate may be a value smaller than the first refresh rate. For example, the second refresh rate may be a frequency between 60 Hz to 120 Hz. An example in which the second refresh rate is half (e.g., 60 Hz) of the first refresh rate is described below with reference to FIG. 8B.

According to an embodiment, when the refresh rate of the display 203 is changed from the first refresh rate to the second refresh rate, the length of the VFP period 313 may be changed from L1 to L2 (increased by ΔL). According to an embodiment, the period ΔVFP of the VFP period 313 may be the blank period 501.

According to an embodiment, as the length of the VFP period 313 increases (for example, the blank period 501 occurs), the electronic device 101 may adjust (e.g., change) the rising timing of the voltage value of the TE-SYNC signal (e.g., the TE-SYNC signal 303 of FIG. 3) within the range of the increased length ΔL of period ΔVFP. For example, the electronic device 101 may adjust (e.g., change) the rising timing of the voltage value of the TE-SYNC signal (e.g., the TE-SYNC signal 303 of FIG. 3) from the first rising timing (①-1) to the second rising timing (①-2), as much as B. According to an embodiment, the length B of the change time may be less than or equal to the increased length ΔL of the period ΔVFP. For example, the increased length ΔL of the period ΔVFP may be the period of a synchronization signal (e.g., the VSYNC signal 301 of FIG. 3).

Referring to (c) and (d) of FIG. 8B, as the rising timing of the voltage value of the TE-SYNC signal (e.g., the TE-SYNC signal 303 of FIG. 3) is changed by B, the transmittable time during which the electronic device 101 may transmit the image frame ("Frame Nth") may be changed (increased) from T3 to T3'. According to an embodiment, as the transmittable time is changed (increased) from T3 to T3', the electronic device 101 may transmit the image frame ("Frame Nth") for the time that has been increased by B. Thus, the operation speed and/or operation frequency required for the processor (e.g., the processor 120 of FIG. 2) to transmit the image frame to the memory 130 within the VACTIVE period 311 (e.g., before the VACTIVE period 311 ends) of the display controller 201 may be reduced, and the power consumption of the processor 120 may be decreased.

According to an embodiment, the first control information transmitted by the processor 120 to the display controller 201 to change the TE-SYNC signal (e.g., the TE-SYNC signal 303 of FIG. 3) may include information about the ratio of the length of the change time B to the length of the blank period 501. For example, the first control information may include information about B/ΔL or its corresponding value (e.g., B/ΔL*100(%)). According to an embodiment, the first control information may include information about the change value corresponding to the change time B. For example, the first control information may include information indicating that the length of the change time (B) is 4 ms and/or 300H.

Figure 9:
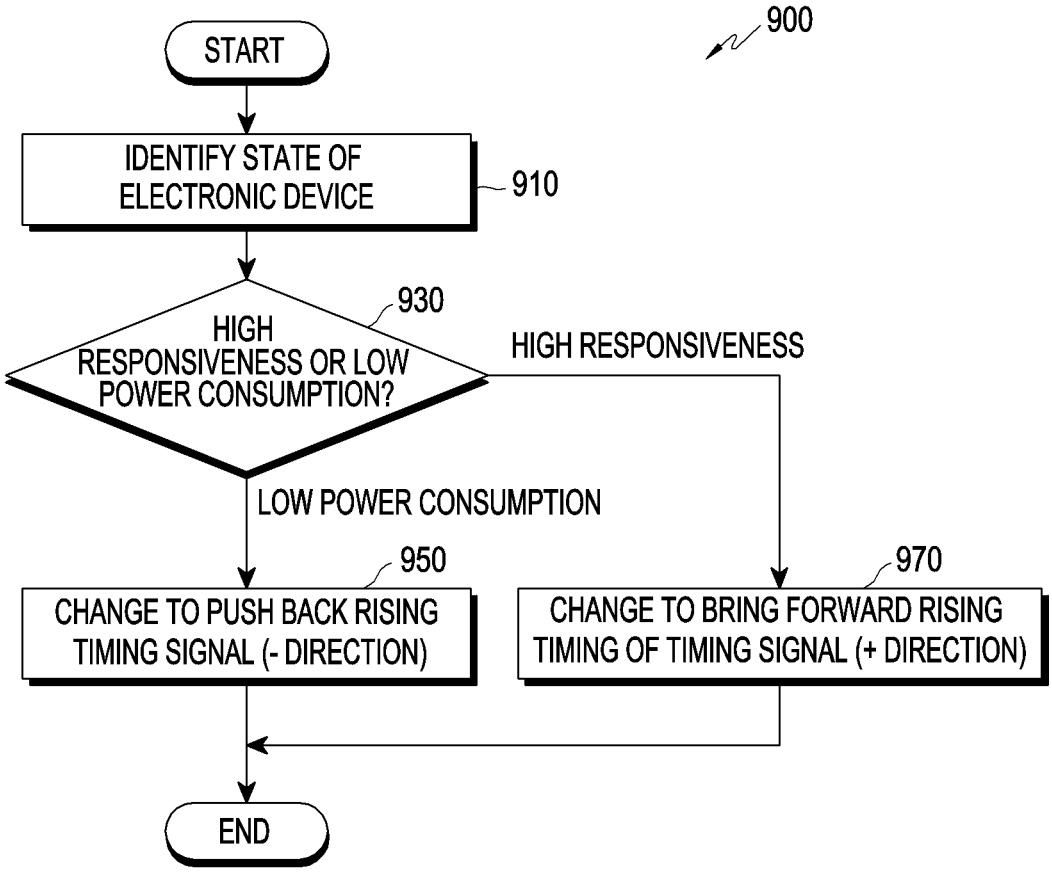
FIG. 9 is a flowchart illustrating the operation of changing a rising timing of a timing signal by an electronic device, according to an embodiment.

FIG. 9 is a flowchart 900 illustrating the operation of changing a rising timing of a timing signal (e.g., TE-SYNC signal 303 of FIG. 3) by an electronic device (e.g., the electronic device 101 of FIG. 1) according to an embodiment.

According to an embodiment, the electronic device 101 may identify the state of the electronic device 101 in operation 910. For example, the state of the electronic device 101 may include at least one of the type of application(s) executed on the electronic device 101, the content of the screen (e.g., the execution screen of the application) displayed on the display (e.g., the display 203 of FIG. 2) of the electronic device 101, the type of user input received, and the temperature of the electronic device 101.

According to an embodiment, the processor 101 may determine whether the state of the electronic device 101 is a state in which high responsiveness is required or a state in which low power consumption is required. According to an embodiment, the electronic device 101 may determine whether the identified state of the electronic device 101 is a state in which high responsiveness is required (or allowed) or a state in which low power consumption is required (or allowed).

According to an embodiment, when it is determined that the identified state of the electronic device 101 is the state in which low power consumption is required, the electronic device 101 may change the rising timing of the timing signal (e.g., the TE-SYNC signal 303 of FIG. 3) to be pushed back in operation 950. According to an embodiment, the state in which low power consumption is required (or allowed) may refer to a state in which low responsiveness is required and/or low responsiveness is allowed. Referring to FIG. 7, the electronic device 101 may change the rising timing (e.g., ① of FIG. 5) of the timing signal (e.g., the TE-SYNC signal 303 of FIG. 3) from the first rising timing (e.g., ①-1 of FIG. 7) to the second rising timing (e.g., ①-2 of FIG. 7) (e.g., in direction ⓐ of FIG. 7). The direction ⓐ of FIG. 7 may be a − direction with respect to the timing when the synchronization signal (e.g., VSYNC signal 301 of FIG. 3) of the display controller (e.g., display controller 201 of FIG. 2) rises (e.g., 707 of FIG. 7).

According to an embodiment, when it is determined that the identified state of the electronic device 101 is the state in which high responsiveness is required, the electronic device 101 may change the rising timing of the timing signal (e.g., the TE-SYNC signal 303 of FIG. 3) to be brought forward in operation 970. According to an embodiment, the state in which high responsiveness is required may refer to a state in which high power consumption is required and/or high power consumption is allowed. Referring to FIG. 7, the electronic device 101 may change the rising timing (e.g., ① of FIG. 5) of the timing signal (e.g., the TE-SYNC signal 303 of FIG. 3) from the second rising timing (e.g., ①-2 of FIG. 7) to the first rising timing (e.g., ①-1 of FIG. 7) (e.g., in direction ⓑ of FIG. 7). The direction ⓑ of FIG. 7 may be a + direction with respect to the timing when the synchronization signal (e.g., VSYNC signal 301 of FIG. 3) of the display controller (e.g., display controller 201 of FIG. 2) rises (e.g., 707 of FIG. 7).

According to an embodiment, the electronic device 101 may perform operation 910 again after performing the above-described operation 950 or 970.

Figure 10A:
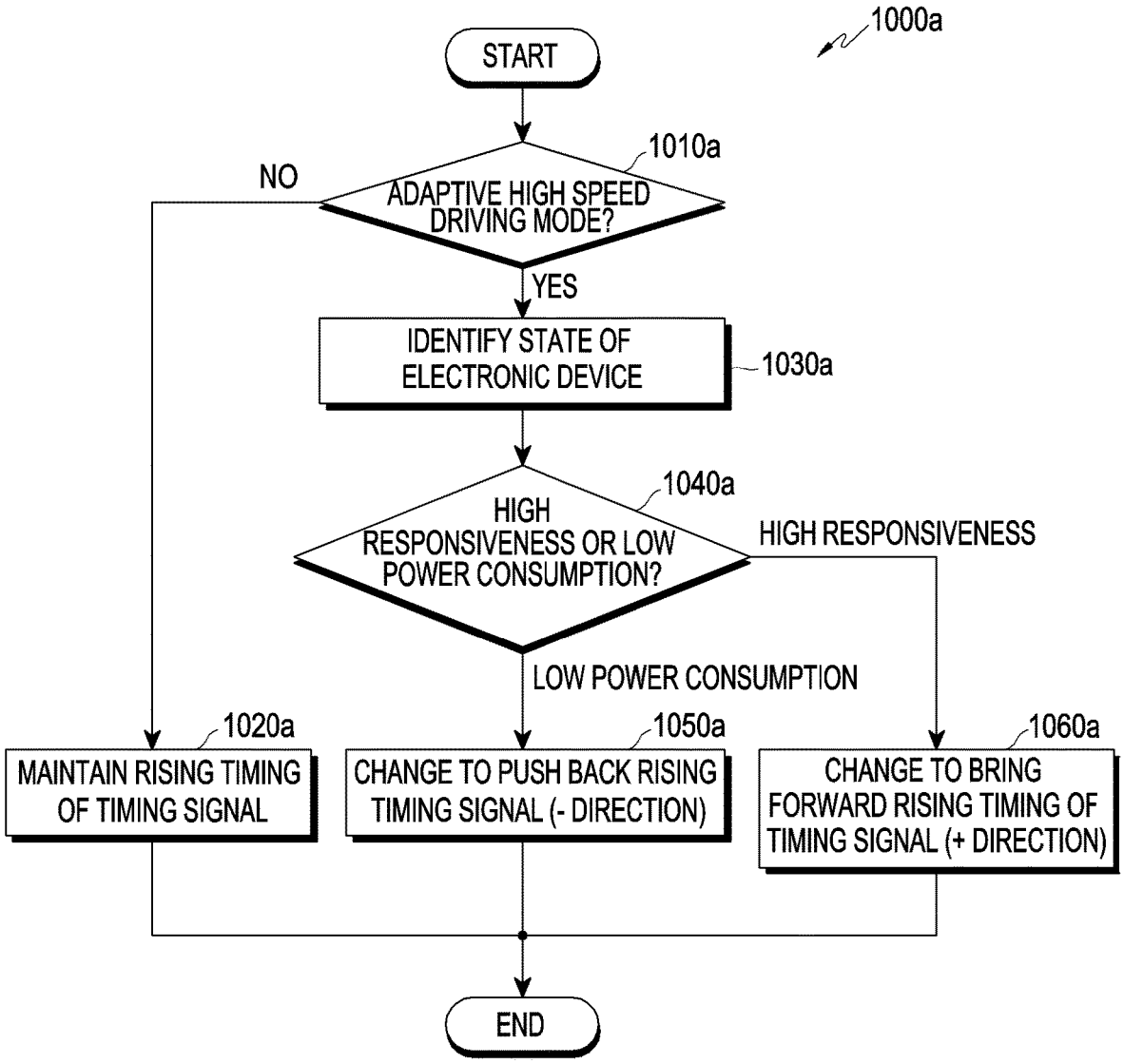
FIG. 10A is a flowchart illustrating the operation of changing a rising timing of a timing signal by an electronic device, according to an embodiment.

FIG. 10A is a flowchart 1000*a* illustrating the operation of changing a rising timing of a timing signal (e.g., TE-SYNC signal 303 of FIG. 3) by an electronic device (e.g., the electronic device 101 of FIG. 1) according to an embodiment. No duplicate description is presented below of those described above in connection with FIG. 9.

According to an embodiment, in operation 1010*a*, the electronic device 101 may determine whether the adaptive high-speed driving mode (e.g., the third mode of FIG. 5) is activated. According to an embodiment, when the adaptive high-speed driving mode is activated, a blank period (e.g., 501 in FIG. 5) exists so that the rising timing of timing signal (e.g., the TE-SYNC signal 303 of FIG. 3) may be changed as shown in FIG. 5, but it should not be interpreted as limited to a specific operation mode (e.g., the adaptive high-speed driving mode or the third mode) in the disclosure. According to an embodiment, operation 1010*a* may be performed by a processor (e.g., the processor 120 of FIG. 1) and/or a display controller (e.g., the display controller 201 of FIG. 2).

According to an embodiment, upon determining that the adaptive high-speed driving mode is not activated, the electronic device 101 may maintain the rising timing of the timing signal (e.g., the TE-SYNC signal 303 of FIG. 3) in operation 1020*a*. According to an embodiment, when the adaptive high-speed driving mode is not activated may mean, e.g., when no blank period (e.g., 501 in FIG. 5) exists as shown in FIG. 4A or 4B, but it should not be interpreted as limited to a specific operation mode (e.g., the normal driving mode, high-speed driving mode, first mode, or second mode) in the disclosure.

According to an embodiment, when it is determined that the adaptive high-speed driving mode is activated, the electronic device 101 may perform operations 1030*a* to 1060*a*. The same description given for operations 910 to 970 of FIG. 9 may apply to operations 1030*a* to 1060*a* and, thus, no description of operations 1030*a* to 1060*a* is presented below.

Figure 10B:
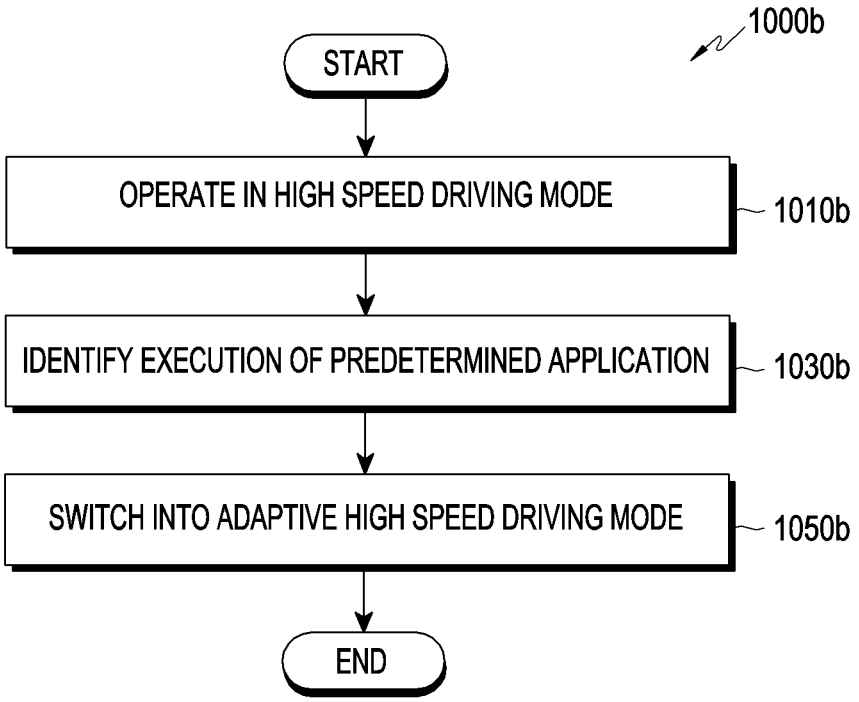
FIG. 10B is a flowchart illustrating a driving mode switch of an electronic device according to an embodiment.

FIG. 10B is a flowchart 1000*b* illustrating a driving mode switch of an electronic device (e.g., the electronic device 101 of FIG. 1) according to an embodiment.

According to an embodiment, the electronic device 101 may operate in the high-speed driving mode in operation 1010*b*. According to an embodiment, the electronic device 101 sets the refresh rate of the display (e.g., the display 203 of FIG. 2) to a high value (e.g., 120 Hz) and may accordingly set the operation speed and/or operation frequency of the processor (e.g., the processor 120 of FIG. 1) to be high. According to an embodiment, the interval of the synchronization signal (e.g., the VSYNC signal 301 of FIG. 3) generated from the display controller (e.g., the display controller 201 of FIG. 2) is a reciprocal (e.g., approximately 8.33 ms (=1/120*1000)) of the refresh rate (e.g., 120 Hz) of the display. For example, the high-speed driving mode may be a driving mode corresponding to the second mode of FIG. 4B.

According to an embodiment, the electronic device 101 may identify an execution of a predetermined application on the electronic device 101 in operation 1030*b*. For example, the predetermined application may include at least one of a camera application and a navigation application. According to an embodiment, the predetermined application is not limited to the above-described example. According to an embodiment, operation 1030*b* may be performed by the processor 120.

According to an embodiment, the electronic device 101 may switch into the adaptive high-speed driving mode in operation 1050*b*. For example, the adaptive high-speed driving mode may mean a mode in which a blank period (e.g., the blank period 501 in FIG. 5) exists so that the rising timing of timing signal (e.g., the TE-SYNC signal 303 of FIG. 3) may be changed as shown in FIG. 5, but it should not be interpreted as limited to a specific operation mode (e.g., the adaptive high-speed driving mode or the third mode) in the disclosure. According to an embodiment, when the predetermined application is identified as executed, the processor 120 may transmit second control information to change the interval of the synchronization signal (e.g., the VSYNC signal 301 of FIG. 3) of the display controller 201 and/or the refresh rate of the display 203 to the display controller 201. For example, the second control information may include a specific set value indicating a refresh rate to be set and/or the interval of the synchronization signal (e.g., VSYNC signal 301). For example, the second control information may include a specific set value indicating a ratio for changing the interval of the synchronization signal (e.g., the VSYNC signal 301) and/or the refresh rate to be set. According to an embodiment, when the predetermined application is identified as executed, the processor 120 may transmit the second control information to change the refresh rate of the display 203 to a refresh rate (e.g., 60 Hz) which is lower than the refresh rate (e.g., 120 Hz) of operation 1010*b* to the display controller 201, thereby controlling the display controller 201 to change the refresh rate of the display 203 to the refresh rate corresponding to the set value included in the second control information. According to an embodiment, when the predetermined application is identified as executed, the processor 120 may transmit the second control information to change the interval of the synchronization signal (e.g., VSYNC signal 301) to an interval (e.g., 16.67 ms (=1/60)), which is longer than the interval (e.g., 8.33 ms) of the synchronization signal (e.g., the VSYNC signal 301) of operation 1010*b* to the display controller 201, thereby controlling the display controller 201 to generate a synchronization signal (e.g., the VSYNC signal 301) having the changed interval (e.g., 16.67 ms). According to an embodiment, as shown in FIG. 5, the scan-on time (e.g., the length of the VACTIVE period 311 in FIG. 3) of the display controller 201 may be the same as when the high refresh rate (e.g., 120 Hz) is set in the display 203. Accordingly, after the refresh rate of the display 203 and/or the interval of the synchronization signal (e.g., VSYNC signal 301) is changed, a blank period (e.g., the blank period 501 of FIG. 5) may occur so that the rising timing of the timing signal (e.g., TE-SYNC signal 303 in FIG. 3) is changed.

Figure 10C:
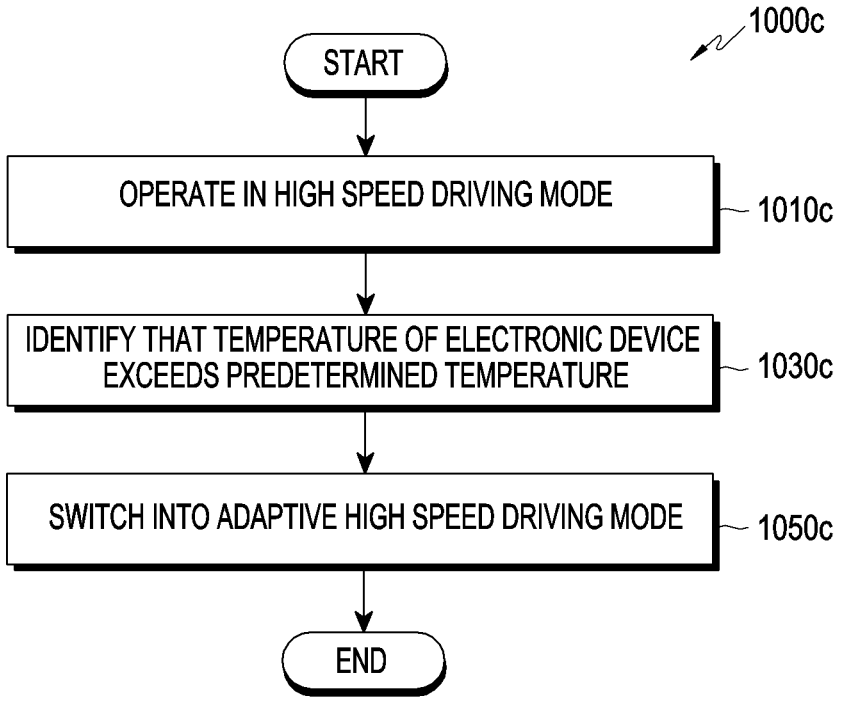
FIG. 10C is a flowchart illustrating a driving mode switch of an electronic device according to an embodiment.

FIG. 10C is a flowchart 1000*c* illustrating a driving mode switch of an electronic device (e.g., the electronic device 101 of FIG. 1) according to an embodiment.

According to an embodiment, the electronic device 101 may operate in the high-speed driving mode in operation 1010*c*. According to an embodiment, the electronic device 101 sets the refresh rate of the display (e.g., the display 203 of FIG. 2) to a high value (e.g., 120 Hz) and may accordingly set the operation speed and/or operation frequency of the processor (e.g., the processor 120 of FIG. 1) to be high. According to an embodiment, the interval of the synchronization signal (e.g., the VSYNC signal 301 of FIG. 3) generated from the display controller (e.g., the display controller 201 of FIG. 2) is a reciprocal (e.g., 8.33 ms (=1/120*1000)) of the refresh rate (e.g., 120 Hz) of the display. For example, the high-speed driving mode may be a driving mode corresponding to the second mode of FIG. 4B.

According to an embodiment, the electronic device 101 may identify that the temperature of the electronic device 101 exceeds a predetermined temperature in operation 1030*c*. For example, the temperature of the electronic device 101 may be the temperature sensed for a component (e.g., the processor 120 or the display 203) of the electronic device 101. For example, the predetermined temperature may be 50° C. According to an embodiment, operation 1030*b* may be performed by the processor 120 and/or a temperature sensor (e.g., the sensor module 176 of FIG. 1).

According to an embodiment, the electronic device 101 may switch into the adaptive high-speed driving mode in operation 1050*c*. For example, the adaptive high-speed driving mode may mean a mode in which a blank period (e.g., 501 in FIG. 5) exists so that the rising timing of timing signal (e.g., the TE-SYNC signal 303 of FIG. 3) may be changed as shown in FIG. 5, but it should not be interpreted as limited to a specific operation mode (e.g., the adaptive high-speed driving mode or the third mode) in the disclosure. According to an embodiment, when it is identified that the temperature of the electronic device 101 exceeds the predetermined temperature, the processor 120 may transmit second control information to change the interval of the synchronization signal (e.g., the VSYNC signal 301 of FIG. 3) of the display controller 201 and/or the refresh rate of the display 203 to the display controller 201. According to an embodiment, the description of the second control information in operation 1050*b* of FIG. 10B may be applied to the second control information, and no detailed description thereof is thus given.

Figure 11A:
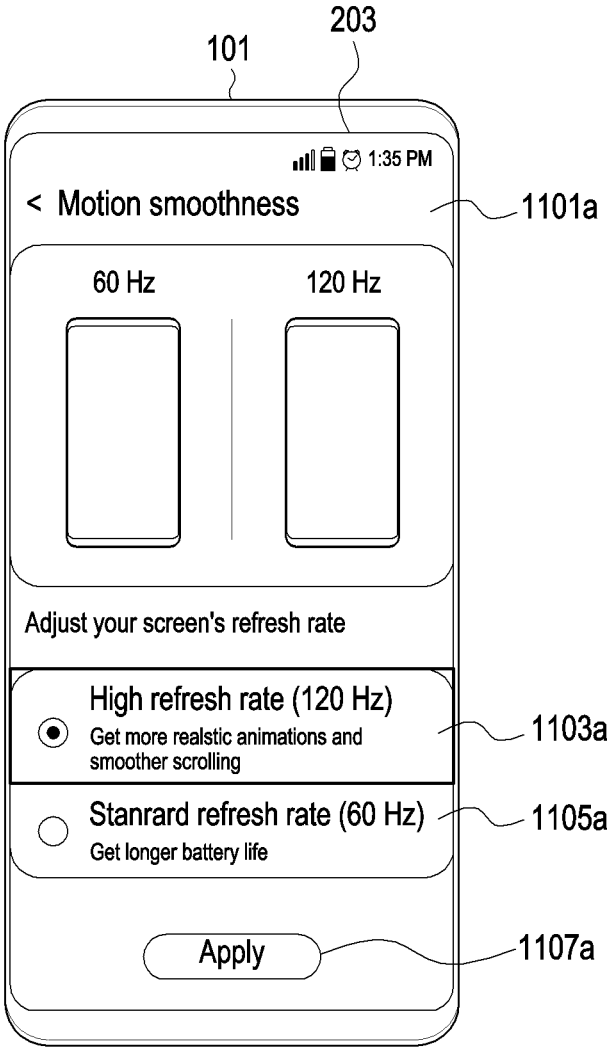
FIG. 11A is a view illustrating a screen for setting a refresh rate of an electronic device according to an embodiment.

FIG. 11A is a view illustrating a screen for setting a refresh rate of an electronic device 101 according to an embodiment.

Referring to FIG. 11A, a setting screen 1101*a* for setting the refresh rate of the display 203 may be displayed on the display 203 of the electronic device 101. According to an embodiment, the display 203 may include a touchscreen for receiving touch input.

According to an embodiment, the setting screen 1101*a* may include a first item 1103*a* corresponding to a high refresh rate ("High refresh rate") and a second item 1105*a* corresponding to a standard refresh rate ("Stand refresh rate"). According to an embodiment, the standard refresh rate may be a relatively lower refresh rate than the high refresh rate. For example, the high refresh rate may be 120 Hz, and the standard refresh rate may be 60 Hz. According to an embodiment, the setting screen 1101*a* may further include an apply button ("Apply") 1107*a*.

According to an embodiment, the first item 1103*a* may correspond to at least one of the second mode of FIG. 4B or the third mode of FIG. 5. According to an embodiment, the second item 1105*a* may correspond to the first mode of FIG. 4A.

According to an embodiment, the processor (e.g., the processor 120 of FIG. 1) may receive an input for selecting one of the first item 1103*a* or the second item 1105*a* from the user. According to an embodiment, the processor 120 may receive an input (e.g., a touch input) for selecting one of the first item 1103*a* or the second item 1105*a* using a touch screen and receive an input (e.g., a touch input) for selecting the apply button 1107*a*.

According to an embodiment, when the first item 1103*a* is selected, the processor 120 may control the electronic device 101 to operate in either the second mode of FIG. 4B or the third mode of FIG. 5.

According to an embodiment, when the first item 1103*a* corresponds to the second mode of FIG. 4B, the display 203 may be set to the high refresh rate (e.g., 120 Hz), and the display controller (e.g., the display controller 201 of FIG. 2) may be set to a short interval (e.g., 8.33 ms) of the synchronization signal (e.g., the VSYNC signal 301 of FIG. 3). For example, the processor 120 may operate at a relatively high operation speed and/or a high operation frequency. According to an embodiment, upon identifying that a predetermined application (e.g., a camera application or navigation application) is executed or upon identifying that the temperature of the electronic device 101 exceeds a predetermined temperature (e.g., 50° C.), the processor 120 may reduce the refresh rate of the display 203. For example, the refresh rate of the display 203 may be changed from a high refresh rate (e.g., 120 Hz) to a relatively low refresh rate (e.g., a value included in the range from 60 Hz to 120 Hz). According to an embodiment, the electronic device 101 may switch from the second mode of FIG. 4B to the third mode of FIG. 5. Accordingly, the operation speed and/or operation frequency of the processor 120 may be lowered.

According to an embodiment, when the first item 1103*a* corresponds to the third mode of FIG. 5, the display 203 may be set to a relatively low refresh rate (e.g., a value included in the range from 60 Hz to 120 Hz) as shown in FIG. 5, and the display controller (e.g., the display controller 201 of FIG. 2) may be set to a relatively long interval of the synchronization signal (e.g., the VSYNC signal 301 of FIG. 3). According to an embodiment, the electronic device 101 may operate in the third mode of FIG. 5.

According to an embodiment, when the electronic device 101 is switched to the third mode or operates in the third mode, the processor 120 may change the rising timing of the voltage value of the timing signal (e.g., the TE-SYNC signal 303 of FIG. 3) based on the state of the electronic device 101. Accordingly, the operation speed and/or operation frequency of the processor 120 may be changed.

Figure 11B:
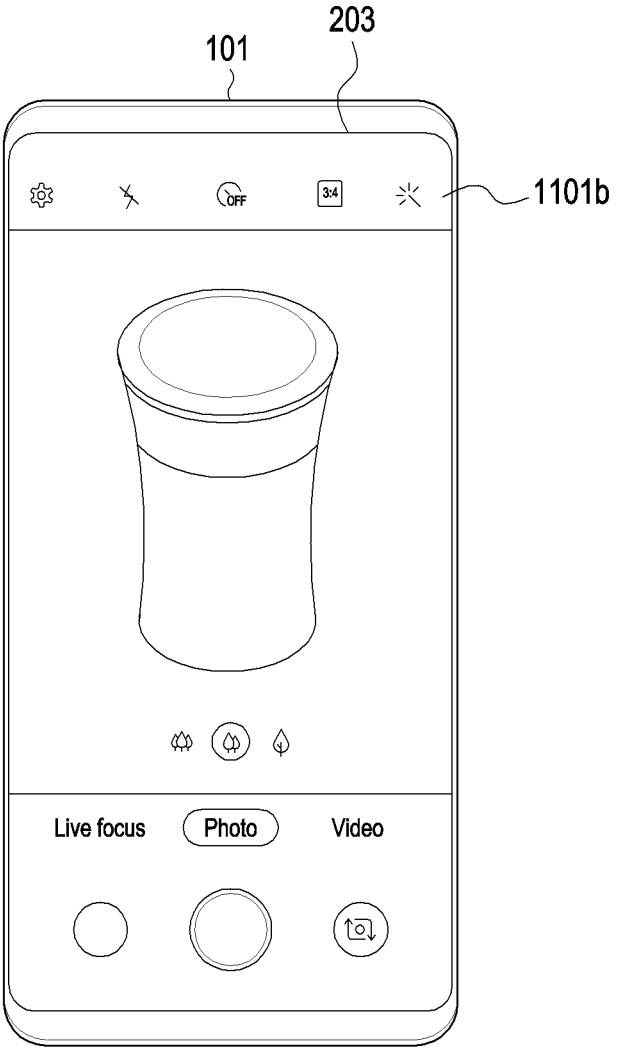
FIG. 11B is a view illustrating a preset application according to an embodiment.

FIG. 11B is a view illustrating a preset application according to an embodiment.

According to an embodiment, the predetermined application (e.g., the predetermined application of FIG. 10B) may be a camera application.

Referring to FIG. 11B, an execution screen 1101*b* of the camera application may be displayed on the display 203 of the electronic device 101.

According to an embodiment, upon identifying that the camera application is executed or the execution screen of the camera application is displayed, the processor 120 may operate in the third mode (for example, the third mode in FIG. 5) or switch from the second mode (e.g., the second mode of FIG. 4B) to the third mode (e.g., the third mode of FIG. 5).

According to an embodiment, the camera application may be an application configured to generate an image frame (e.g., the image frame of FIG. 3) at a low frame rate (e.g., 60 Hz). According to an embodiment, the processor 120 may identify the refresh rate set to the display 203 and identify that the identified refresh rate is higher than the frame rate of the camera application. According to an embodiment, when it is identified that the identified refresh rate is higher than the frame rate of the camera application, the processor 120 may determine that the refresh rate of the display 203 can be lowered and, to reduce the power consumption of the display 203 and/or the display controller 201, control the display 203 and/or the display controller 201 to reduce the refresh rate of the display 203. According to an embodiment, the processor 120 may change the rising timing of the voltage value of the timing signal (e.g., the TE-SYNC signal 303 of FIG. 3) based on the state of the electronic device 101. Accordingly, the operation speed and/or operation frequency of the processor 120 may be changed.

According to an embodiment, when it is identified that the predetermined application (e.g., a camera application) is terminated or is switched to another execution screen of the predetermined application, the processor 120 may control the display 203 and/or the display controller 201 to increase the refresh rate of the display 203.

Figure 11C:
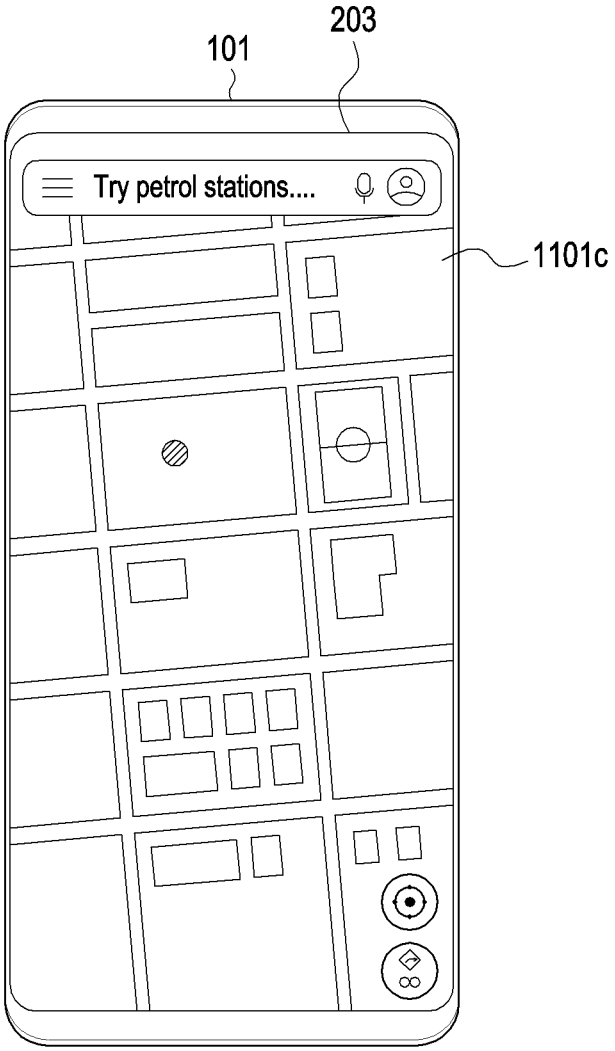
FIG. 11C is a view illustrating another preset application according to an embodiment.

FIG. 11C is a view illustrating another preset application according to an embodiment.

According to an embodiment, the predetermined application (e.g., the predetermined application of FIG. 10B) may be a navigation application.

Referring to FIG. 11C, an execution screen 1101*c* of the navigation application may be displayed on the display 203 of the electronic device 101.

According to an embodiment, upon identifying that the navigation application is executed or the execution screen of the navigation application is displayed, the processor 120 may operate in the third mode (for example, the third mode in FIG. 5) or switch from the second mode (e.g., the second mode of FIG. 4B) to the third mode (e.g., the third mode of FIG. 5).

According to an embodiment, the navigation application may be an application configured to generate an image frame (e.g., the image frame of FIG. 3) at a low frame rate (e.g., 60 Hz). According to an embodiment, the processor 120 may identify the refresh rate set to the display 203 and identify that the identified refresh rate is higher than the frame rate of the camera application. According to an embodiment, when it is identified that the identified refresh rate is higher than the frame rate of the camera application, the processor 120 may determine that the refresh rate of the display 203 can be lowered and, to reduce the power consumption of the display 203 and/or the display controller 201, control the display 203 and/or the display controller 201 to reduce the refresh rate of the display 203. According to an embodiment, the processor 120 may change the rising timing of the voltage value of the timing signal (e.g., the TE-SYNC signal 303 of FIG. 3) based on the state of the electronic device 101. Accordingly, the operation speed and/or operation frequency of the processor 120 may be changed.

According to an embodiment, the navigation application may be an application configured to consume high power. For example, since a signal of a wireless communication scheme (e.g., global positioning system (GPS)) may be transmitted and/or received according to an operation of the navigation application, the navigation application may be an application that consumes high power. According to an embodiment, the electronic device 101 may identify that the executed navigation application is an application that consumes high power and, to reduce the power consumption of the display controller 201, the electronic device 101 may control the display 203 and/or the display controller 201 to lower the refresh rate of the display 203. According to an embodiment, the processor 120 may change the rising timing of the voltage value of the timing signal (e.g., the TE-SYNC signal 303 of FIG. 3) based on the state of the electronic device 101. Accordingly, the operation speed and/or operation frequency of the processor 120 may be changed.

Figure 12A:
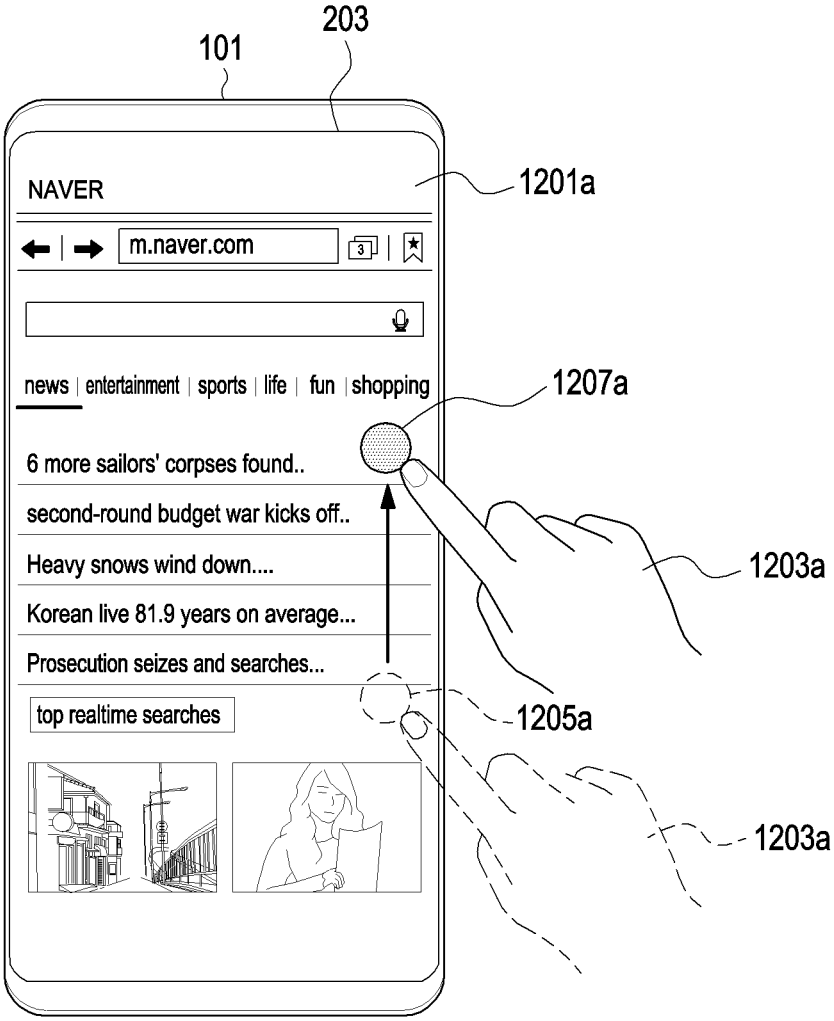
FIG. 12A is a view illustrating the operation of changing a timing signal by an electronic device in response to a user input, according to an embodiment.

FIG. 12A is a view illustrating the operation of changing a timing signal (e.g., the TE-SYNC signal 303 of FIG. 3), by an electronic device (e.g., the electronic device 101 of FIG. 1), according to a user input, according to an embodiment.

Referring to FIG. 12A, an execution screen 1201*a* of an application (e.g., an Internet application) may be displayed on the display 203 of the electronic device 101.

According to an embodiment, the processor (e.g., the processor 120 of FIG. 1) may receive a drag input for scrolling the execution screen 1201*a* from the user 1203*a* using the display 203 (e.g., touchscreen). Referring to FIG. 12A, an input for dragging from a first point 1205*a* to a second point 1207*a* may be received. According to an embodiment, the processor 120 may control the display controller (e.g., the display controller 201 of FIG. 2) to change the timing signal (e.g., the TE-SYNC signal 303 of FIG. 3). According to an embodiment, the electronic device 101 may be in the state of operating in the third mode of FIG. 5. According to an embodiment, upon receiving a drag input on the execution screen 1201*a*, the processor 120 may control the display controller 201 to change the rising timing (e.g., ① of FIG. 5) of the timing signal (e.g., the TE-SYNC signal 303 of FIG. 3) from the second rising timing (e.g., ①-2 of FIG. 7) to the first rising timing (e.g., ①-1 of FIG. 7) (e.g., in direction ⓑ of FIG. 7).

According to an embodiment, upon identifying that the received drag input for scrolling the execution screen 1201*a* is released, the processor 120 may control the display controller 201 to change the rising timing (e.g., ① of FIG. 5) of the timing signal (e.g., the TE-SYNC signal 303 of FIG. 3) from the first rising timing (e.g., ①-1 of FIG. 7) to the second rising timing (e.g., ①-2 of FIG. 7) (e.g., in direction ⓑ of FIG. 7).

Figure 12B:
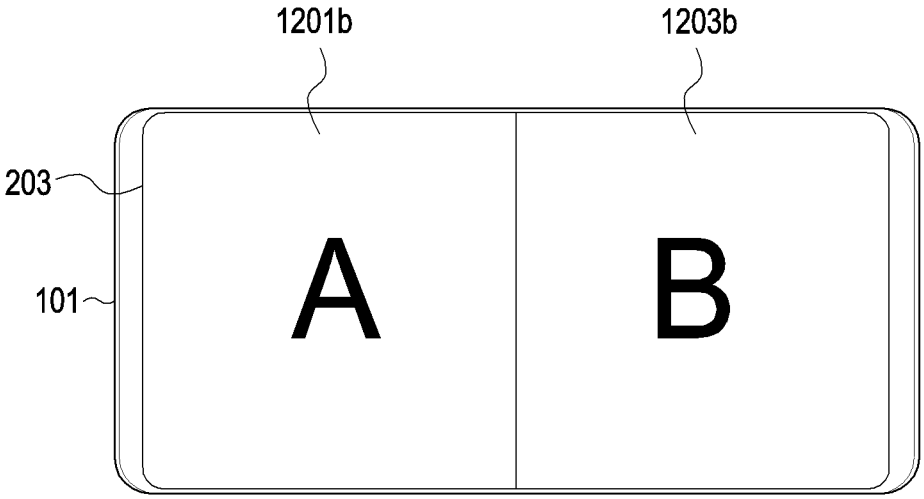
FIG. 12B is a view illustrating the operation of determining a timing signal when a plurality of execution screens are displayed, by an electronic device, according to an embodiment.

FIG. 12B is a view illustrating the operation of determining a timing signal (e.g., the TE-SYNC signal 303 of FIG. 3), by an electronic device (e.g., the electronic device 101 of FIG. 1), when a plurality of execution screens are displayed, according to a user input, according to an embodiment.

Referring to FIG. 12B, the respective execution screens 1201*b* and 1203*b* of the plurality of applications (e.g., an Internet application and a camera application) may be displayed on the display 203 of the electronic device 101. According to an embodiment, the plurality of applications may be the same type of applications or different types of applications.

According to an embodiment, the processor (e.g., the processor 120 of FIG. 1) may identify the type of the plurality of executed applications and/or contents of execution screens of the displayed applications.

According to an embodiment, the processor 120 may generate a timing signal (e.g., the TE-SYNC signal 303 of FIG. 3) based on the identified type of the plurality of applications and/or the identified content of the execution screens.

According to an embodiment, the processor 120 may identify whether at least one of the plurality of executed applications is an application corresponding to high responsiveness. For example, when a game application and an Internet application are executed, the processor 120 may determine that the game application is an application requiring high responsiveness. According to an embodiment, upon identifying that at least one of the plurality of executed applications is an application corresponding to high responsiveness, the processor 120 may control the display controller (e.g., the display controller 201 of FIG. 2) to change the rising timing (e.g., ① of FIG. 5) of the timing signal (e.g., the TE-SYNC signal 303 of FIG. 3) from the second rising timing (e.g., ①-2 of FIG. 7) to the first rising timing (e.g., ①-1 of FIG. 7) (e.g., in direction ⓑ of FIG. 7).

According to an embodiment, upon identifying that all of the plurality of executed applications are applications corresponding to low power consumption (e.g., for which low responsiveness is allowed), the processor 120 may control the display controller (e.g., the display controller 201 of FIG. 2) to change the rising timing (e.g., ① of FIG. 5) of the timing signal (e.g., the TE-SYNC signal 303 of FIG. 3) from the first rising timing (e.g., ①-1 of FIG. 7) to the second rising timing (e.g., ①-2 of FIG. 7) (e.g., in direction ⓐ of FIG. 7). According to an embodiment, upon identifying that at least one of the plurality of executed applications is an application corresponding to low power consumption (e.g., for which low responsiveness is allowed), the processor 120 may control the display controller (e.g., the display controller 201 of FIG. 2) to change the rising timing (e.g., ① of FIG. 5) of the timing signal (e.g., the TE-SYNC signal 303 of FIG. 3) from the first rising timing (e.g., ①-1 of FIG. 7) to the second rising timing (e.g., ①-2 of FIG. 7) (e.g., in direction ⓐ of FIG. 7).

According to an embodiment, when a video with high FPS is being output via at least one of the displayed execution screens of the plurality of applications, the processor 120 may control the display controller (e.g., the display controller 201 of FIG. 2) to change the rising timing (e.g., ① of FIG. 5) of the timing signal (e.g., the TE-SYNC signal 303 of FIG. 3) from the second rising timing (e.g., ①-2 of FIG. 7) to the first rising timing (e.g., ①-1 of FIG. 7) (e.g., in direction ⓑ of FIG. 7).

According to an embodiment, when videos with low FPS are being output via all of the displayed execution screens of the plurality of applications, the processor 120 may control the display controller (e.g., the display controller 201 of FIG. 2) to change the rising timing (e.g., ① of FIG. 5) of the timing signal (e.g., the TE-SYNC signal 303 of FIG. 3) from the first rising timing (e.g., ①-1 of FIG. 7) to the second rising timing (e.g., ①-2 of FIG. 7) (e.g., in direction ⓐ of FIG. 7).

According to an embodiment, what has been described above is merely an example. When a user input (e.g., a scroll gesture) requiring high responsiveness is received through any one of the plurality of execution screens 1201*b* and 1203*b*, the processor 120 may control the display controller (e.g., the display controller 201 of FIG. 2) to change the rising timing (e.g., ① of FIG. 5) of the timing signal (e.g., the TE-SYNC signal 303 of FIG. 3) from the second rising timing (e.g., ①-2 of FIG. 7) to the first rising timing (e.g., ①-1 of FIG. 7) (e.g., in direction ⓑ of FIG. 7).

Figure 13:
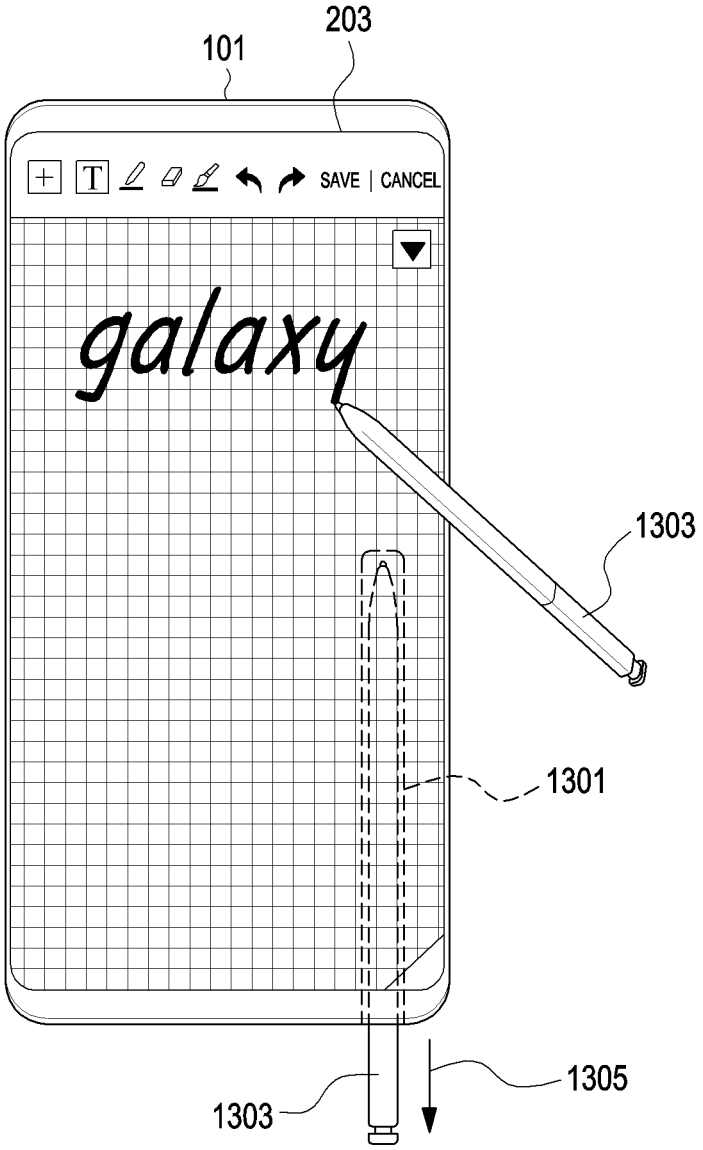
FIG. 13 is a view illustrating the operation of determining a timing signal, by an electronic device, based on a stylus pen, according to an embodiment.

FIG. 13 is a view illustrating the operation of determining a timing signal (e.g., the TE-SYNC signal 303 of FIG. 3), by an electronic device (e.g., the electronic device 101 of FIG. 1), based on the stylus pen 1303, according to a user input, according to an embodiment.

According to an embodiment, the processor (e.g., the processor 120 of FIG. 1) may identify a removal 1305 (e.g., popped-up) of the stylus pen 1303 from the housing 1301 of the electronic device 101. According to an embodiment, the processor 120 may identify the removal of the stylus pen 1303 using a sensor (e.g., the sensor module 176 of FIG. 1) included in the housing. According to an embodiment, when a short-range wireless communication signal (e.g., a signal received through Bluetooth communication) is detected from the stylus pen 1303, the processor 120 may identify that the stylus pen 1303 is removed.

According to an embodiment, the processor 120 may receive an input by the stylus pen 1303. For example, the input by the stylus pen 1303 may include at least one of a touch, tap, hovering, or drag using the stylus pen 1303. For example, the input by the stylus pen 1303 may include a short-range wireless communication signal (e.g., a signal received through Bluetooth communication) from the stylus pen 1303.

According to an embodiment, when a removal 1305 of the stylus pen 1303 is identified or when an input by the stylus pen 1303 is received, the processor 120 may determine that it is in the state where high responsiveness is required. According to an embodiment, when a removal 1305 of the stylus pen 1303 is identified or when an input by the stylus pen 1303 is received, the processor 120 may control the display controller (e.g., the display controller 201 of FIG. 2) to change the rising timing (e.g., ① of FIG. 5) of the timing signal (e.g., the TE-SYNC signal 303 of FIG. 3) from the second rising timing (①-2) to the first rising timing (①-1) (e.g., in direction ⓑ of FIG. 7).

According to an embodiment, an electronic device (e.g., the electronic device 101 of FIG. 1) comprises at least one processor (e.g., the processor 120 of FIG. 1), a display (e.g., the display 203 of FIG. 2), a memory (e.g., the memory 130 of FIG. 1) configured to store an image frame received from the at least one processor, and a display controller (e.g., the display controller 201 of FIG. 2) configured to output the image frame stored in the memory through the display, wherein the at least one processor is configured to transmit, to the memory, a first image frame (e.g., the image frame of FIG. 3) to be output through the display, based on a first timing signal (e.g., the TE-SYNC signal 303 of FIG. 3) received from the display controller, identify a state of the electronic device, transmit, to the display controller, first control information for changing a timing of the first timing signal, based on the identified state of the electronic device, in response to transmitting the first control information for changing the timing of the first timing signal, receive a second timing signal from the display controller, and transmit, to the memory, a second image frame to be output through the display, based on the received second timing signal. The timing of the second timing signal may differ from the timing of the first timing signal.

According to an embodiment, the at least one processor may be configured to transmit the first image frame to the memory during a first transmission time in response to a rising of the first timing signal and transmit the second image frame to the memory during a second transmission time in response to a rising of the second timing signal. The second transmission time may differ from the first transmission time.

According to an embodiment, the at least one processor may be configured to transmit the first image frame to the memory at a first operation speed during the first transmission time and transmit the second image frame to the memory at a second operation speed during the second transmission time. The second operation speed may differ from the first operation speed.

According to an embodiment, the at least one processor may be configured to transmit, to the display controller, the first control information for changing a rising timing of the first timing signal, based on the identified state of the electronic device.

According to an embodiment, the first control information may include information regarding a change time to change the rising timing of the first timing signal.

According to an embodiment, the display controller may be configured to transmit at least one of the first image frame or the second image frame stored in the memory to the display, based on a synchronization signal (e.g., the VSYNC signal 301 of FIG. 3).

According to an embodiment, the display controller may be configured to read, from the memory, and transmit, to the display, at least one of the first image frame or the second image frame received and stored from the at least one processor, based on a rising of the synchronization signal.

According to an embodiment, the at least one processor may be configured to transmit second control information for changing an interval of the synchronization signal to the display controller.

According to an embodiment, the display controller may be configured to change a rising timing of the first timing signal with respect to the synchronization signal, based on the first control information and to transmit the second timing signal having the changed rising timing to the at least one processor.

According to an embodiment, the display controller may be configured to change the rising timing of the first timing signal within a period range of the synchronization signal.

According to an embodiment, the state of the electronic device may include at least one of a type of an executed application, content of a displayed execution screen, a type of a received user input, or a temperature of the electronic device.

According to an embodiment, a method for controlling an electronic device comprises transmitting, a memory of the electronic device, a first image frame to be output through a display of the electronic device to, based on a first timing signal received from a display controller of the electronic device, identifying a state of the electronic device, transmitting, to a display controller of the electronic device, first control information for changing a timing of the first timing signal, based on the identified state of the electronic device, in response to transmitting the first control information for changing the timing of the first timing signal, receiving a second timing signal from the display controller, and transmitting, to the memory, a second image frame to be output through the display, based on the received second timing signal. The timing of the second timing signal may differ from the timing of the first timing signal.

According to an embodiment, transmitting the first image frame based on the first timing signal may comprise transmitting the first image frame to the memory during a first transmission time in response to a rising of the first timing signal, transmitting the second image frame based on the second timing signal may comprise transmitting the second image frame to the memory during a second transmission time in response to a rising of the second timing signal. The second transmission time may differ from the first transmission time.

According to an embodiment, transmitting the first image frame during the first transmission time may comprise transmitting the first image frame to the memory at a first operation speed during the first transmission time. Transmitting the second image frame during the second transmission time may comprise transmitting the second image frame to the memory at a second operation speed during the second transmission time. The second operation speed may differ from the first operation speed.

According to an embodiment, transmitting the first control information for changing the timing of the first timing signal based on the identified state of the electronic device may comprise transmitting the first control information for changing a rising timing of the first timing signal to the display controller, based on the identified state of the electronic device.

According to an embodiment, the first control information may include information regarding a change time to change the rising timing of the first timing signal.

According to an embodiment, the method may further comprise transmitting, by the display controller, at least one of the first image frame or the second image frame stored in the memory to the display, based on a synchronization signal.

According to an embodiment, the method may further comprise transmitting second control information for changing an interval of the synchronization signal to the display controller.

According to an embodiment, the method may further comprise changing, by the display controller, a rising timing of the first timing signal with respect to the synchronization signal, based on the received first control information and transmitting, by the display controller, the second timing signal having the changed rising timing to the at least one processor.

According to an embodiment, there is provided a computer-readable non-volatile recording medium, storing instructions configured to, when executed, cause at least one processor of an electronic device to transmit, to a memory of the electronic device, a first image frame to be output through a display of the electronic device, based on a first timing signal received from a display controller of the electronic device, identify a state of the electronic device, transmit, to a display controller of the electronic device, first control information for changing a timing of the first timing signal, based on the identified state of the electronic device, in response to transmitting the first control information for changing the timing of the first timing signal, receive a second timing signal from the display controller, and transmit, to the memory, a second image frame to be output through the display, based on the received second timing signal. The timing of the second timing signal may differ from the timing of the first timing signal. The electronic device according to various embodiments may be one of various types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program products may be traded as commodities between sellers and buyers. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server. According to an embodiment, each component (e.g., a module or a program) of the above-described components may include a single entity or multiple entities. According to an embodiment, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to an embodiment, operations performed by the module, the program, or another component may be carried out sequentially, in parallel, repeatedly, or heuristically, or one or more of the operations may be executed in a different order or omitted, or one or more other operations may be added.

As is apparent from the foregoing description, according to certain embodiments, the electronic device may provide a seamless refresh rate switch of the display by maintaining the scan-on time of the display driver IC even if the interval of the synchronization signal (e.g., a VSYNC signal) is changed.

According to certain embodiments, the electronic device may adjust the time when data (e.g., an image frame) may be transmitted to the display driver IC (or GRAM) by changing the timing of the timing signal received in response to a synchronization signal (e.g., VSYNC signal), thereby adjusting the operation speed of the processor and/or the power consumption of the processor.

Various effects and advantages achievable according to the disclosure are not limited by the foregoing descriptions.

Certain of the above-described embodiments of the present disclosure can be implemented in hardware, firmware or via the execution of software or computer code that can be stored in a recording medium such as a CD ROM, a Digital Versatile Disc (DVD), a magnetic tape, a RAM, a floppy disk, a hard disk, or a magneto-optical disk or computer code downloaded over a network originally stored on a remote recording medium or a non-transitory machine readable medium and to be stored on a local recording medium, so that the methods described herein can be rendered via such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein.

While the disclosure has been shown and described with reference to certain exemplary embodiments thereof, it will be understood by those skilled in the art that various changes in form and details may be made therein without departing from the spirit and scope of the disclosure as defined by the appended claims and their equivalents.

What is claimed is:

1. An electronic device, comprising:

at least one processor;

a display;

a memory configured to store an image frame received from the at least one processor; and a display controller configured to output the image frame stored in the memory through the display, wherein the at least one processor is configured to:

transmit, to the memory, a first image frame to be output through the display, based on a first timing signal received from the display controller, wherein the display controller is configured to transmit, to the display, an image frame data stored in the memory to the display based on a rising time of a synchronization signal, wherein the first timing signal is synchronous with the synchronization signal;

identify a state of the electronic device;

transmit, to the display controller, first control information for changing a rising timing of the first timing signal, based on the identified state of the electronic device;

in response to transmitting the first control information for changing the rising timing of the first timing signal, receive a second timing signal from the display controller; and transmit, to the memory, a second image frame to be output through the display, based on the received second timing signal, wherein the second timing signal is asynchronous with the synchronization signal.

2. The electronic device of claim 1, wherein the at least one processor is configured to:

transmit the first image frame to the memory during a first transmission time in response to a rising of the first timing signal; and transmit the second image frame to the memory during a second transmission time in response to a rising of the second timing signal, wherein the second transmission time differs from the first transmission time.

3. The electronic device of claim 2, wherein the at least one processor is configured to:

transmit the first image frame to the memory at a first operation speed during the first transmission time; and transmit the second image frame to the memory at a second operation speed during the second transmission time, wherein the second operation speed differs from the first operation speed.

4. The electronic device of claim 1, wherein the first control information includes information regarding a changing time of the rising timing of the first timing signal.

5. The electronic device of claim 1, wherein the display controller is configured to transmit the first image frame and/or the second image frame stored in the memory to the display, based on the synchronization signal.

6. The electronic device of claim 5, wherein the display controller is configured to read, from the memory, and transmit, to the display, the first image frame and/or the second image frame received and stored from the at least one processor, based on the rising time of the synchronization signal.

7. The electronic device of claim 5, wherein the at least one processor is configured to transmit second control information for changing an interval of the synchronization signal to the display controller.

8. The electronic device of claim 5, wherein the display controller is configured to change the rising timing of the first timing signal with respect to the synchronization signal, based on the first control information, and to transmit the second timing signal having the changed rising timing to the at least one processor.

9. The electronic device of claim 8, wherein the display controller is configured to change the rising timing of the first timing signal within a period range of the synchronization signal.

10. The electronic device of claim 1, wherein the state of the electronic device includes a type of an executed application, content of a displayed execution screen, a type of a received user input, and/or a temperature of the electronic device.

11. A method for controlling an electronic device, the method comprising:

transmitting, to a memory of the electronic device, a first image frame to be output through a display of the electronic device, based on a first timing signal received from a display controller of the electronic device, wherein the display controller is configured to transmit, to the display, an image frame data stored in the memory to the display based on a rising time of a synchronization signal, wherein the first timing signal is synchronous with the synchronization signal;

identifying a state of the electronic device;

transmitting, to a display controller of the electronic device, first control information for changing a rising timing of the first timing signal, based on the identified state of the electronic device;

in response to transmitting the first control information for changing the rising timing of the first timing signal, receiving a second timing signal from the display controller; and transmitting, to the memory, a second image frame to be output through the display, based on the received second timing signal, wherein the second timing signal is asynchronous with the synchronization signal.

12. The method of claim 11, wherein transmitting the first image frame based on the first timing signal further comprises:

transmitting the first image frame to the memory during a first transmission time in response to a rising of the first timing signal, wherein transmitting the second image frame based on the second timing signal further comprises:

transmitting the second image frame to the memory during a second transmission time in response to a rising of the second timing signal, and wherein the second transmission time differs from the first transmission time.

13. The method of claim 12, wherein transmitting the first image frame during the first transmission time further comprises:

transmitting the first image frame to the memory at a first operation speed during the first transmission time, wherein transmitting the second image frame during the second transmission time further comprises:

transmitting the second image frame to the memory at a second operation speed during the second transmission time, and wherein the second operation speed differs from the first operation speed.

14. The method of claim 12, wherein transmitting the first control information for changing the rising timing of the first timing signal based on the identified state of the electronic device further comprises:

transmitting the first control information for changing the rising timing of the first timing signal to the display controller, based on the identified state of the electronic device.

15. The method of claim 14, wherein the first control information includes information regarding a changing time of the rising timing of the first timing signal.

16. The method of claim 11, further comprising:

transmitting, by the display controller, the first image frame and/or the second image frame stored in the memory to the display, based on the synchronization signal.

17. The method of claim 16, further comprising:

transmitting second control information for changing an interval of the synchronization signal to the display controller.

18. The method of claim 16, further comprising:

changing, by the display controller, the rising timing of the first timing signal with respect to the synchronization signal, based on the first control information; and transmitting, by the display controller, the second timing signal having the changed rising timing.

19. A non-transitory computer-readable non-volatile recording medium, storing instructions configured to, when executed, cause at least one processor of an electronic device to:

transmit, to a memory of the electronic device, a first image frame to be output through a display of the electronic device, based on a first timing signal received from a display controller of the electronic device, wherein the display controller is configured to transmit, to the display, an image frame data stored in the memory to the display based on a rising time of a synchronization signal, wherein the first timing signal is synchronous with the synchronization signal;

identify a state of the electronic device;

transmit, to a display controller of the electronic device, first control information for changing a rising timing of the first timing signal, based on the identified state of the electronic device;

in response to transmitting the first control information for changing the rising timing of the first timing signal, receive a second timing signal from the display controller; and transmit, to the memory, a second image frame to be output through the display, based on the received second timing signal, wherein the second timing signal is asynchronous with the synchronization signal.

* * * * *